US012778274B2

(12) United States Patent
De Bardonneche et al.

(10) Patent No.: US 12,778,274 B2
(45) Date of Patent: Nov. 3, 2026

(54) DEVICE FOR APPLICATION OF A FLUID PRODUCT

(71) Applicant: SOCIETE INDUSTRIELLE DE MATIERES PLASTIQUES, ZAC du Plessis-Saucourt (FR)

(72) Inventors: Eric De Bardonneche, Montaren-et-Saint-Médiers (FR); Hugues Chabrerie, Corbeil-Essonnes (FR)

(73) Assignee: Societe Industrielle Matieres Plastiques, ZAC du Plessis-Saucourt (FR)

( * ) Notice: Subject to any disclaimer, the term of this patent is extended or adjusted under 35 U.S.C. 154(b) by 1191 days.

(21) Appl. No.: 17/265,735

(22) PCT Filed: Dec. 20, 2018

(86) PCT No.: PCT/FR2018/053486
§ 371 (c)(1),
(2) Date: Feb. 3, 2021

(87) PCT Pub. No.: WO2020/025862
PCT Pub. Date: Feb. 6, 2020

(65) Prior Publication Data

US 2021/0169208 A1 Jun. 10, 2021

(30) Foreign Application Priority Data

Aug. 3, 2018 (WO) ..... PCT/FR2018/052019

(51) Int. Cl.
*A46B 9/02* (2006.01)
*A45D 40/26* (2006.01)

(52) U.S. Cl.
CPC ..... *A46B 9/021* (2013.01); *A45D 40/262* (2013.01); *A46B 2200/1053* (2013.01)

(58) Field of Classification Search
CPC .... A45D 40/26; A45D 40/262; A45D 34/042; A45D 34/043; A45D 34/045;
(Continued)

(56) References Cited

U.S. PATENT DOCUMENTS 4,561,456 A * 12/1985 Gueret ..... A46D 1/0253 15/207.2
7,992,577 B2 * 8/2011 De Brouwer ..... A45D 34/045 132/218
(Continued)

FOREIGN PATENT DOCUMENTS

DE 202017100439 U1 2/2017
FR 2937514 4/2010
(Continued)

OTHER PUBLICATIONS

Clarivate Analytics copyrighted translation of FR3032869 (Year: 2016).*
(Continued)

*Primary Examiner* — Edelmira Bosques
*Assistant Examiner* — Sarah Woodhouse
(74) *Attorney, Agent, or Firm* — SoCal IP Law Group LLP; Mark Andrew Goldstein; Angelo J. Gaz

(57) ABSTRACT

An applicator device for applying a fluid or paste product to keratin fibers or to the skin (epidermis) includes an elongate core which extends along a longitudinal axis X and has a longitudinal cylindrical shape and a plurality of projections distributed across the core. Each projection extends from an anchoring end, in the core, towards a free end and being integral with said core. Each projection also includes, from the anchoring end towards the free end, a proximal stage, a bridge section and a distal stage, wherein at least one of the proximal stage and the bridge section forms a flexible link.

5 Claims, 17 Drawing Sheets

(58) Field of Classification Search
CPC .. A45D 34/046; A45D 40/264; A45D 40/265; A45D 40/267; A46B 9/021; A46B 9/025; A46B 9/02; A46B 2200/1046; A46B 2200/1053
USPC ..... D4/128, 133, 136
See application file for complete search history.

(56) References Cited

U.S. PATENT DOCUMENTS

| | | | | |
|---|---|---|---|---|
| 8,950,413 | B2 * | 2/2015 | Kulik | A46B 3/005 132/901 |
| 9,326,584 | B2 | 5/2016 | Jacob et al. | |
| 9,545,153 | B2 * | 1/2017 | Chen | A47B 88/43 |
| 12,048,373 | B2 * | 7/2024 | Schreiber | A46B 9/028 |
| 12,226,009 | B2 * | 2/2025 | Schreiber | A46D 1/0292 |
| 2003/0213498 | A1 * | 11/2003 | Gueret | A46B 9/028 132/218 |
| 2006/0002758 | A1 * | 1/2006 | Gueret | A46B 1/00 401/122 |
| 2009/0133707 | A1 * | 5/2009 | Gueret | A45D 40/265 401/121 |
| 2009/0276973 | A1 | 11/2009 | Bouix et al. | |
| 2010/0037911 | A1 * | 2/2010 | Kim | A46B 9/021 132/218 |
| 2011/0229246 | A1 * | 9/2011 | Kulik | A46B 9/021 132/218 |
| 2012/0170965 | A1 * | 7/2012 | Kulik | A46D 1/0253 401/121 |
| 2014/0003857 | A1 * | 1/2014 | Gueret | A46B 9/021 132/218 |
| 2015/0024080 | A1 * | 1/2015 | Jacob | A46D 1/0253 425/542 |
| 2015/0257514 | A1 * | 9/2015 | Thierer | A46B 9/021 401/122 |
| 2016/0022012 | A1 | 1/2016 | Jacob et al. | |
| 2016/0023388 | A1 * | 1/2016 | Jacob | A46D 1/0261 425/542 |
| 2017/0000242 | A1 * | 1/2017 | Jacob | A46D 1/0292 |
| 2017/0290412 | A1 * | 10/2017 | Pires | A46B 9/028 |
| 2018/0242714 | A1 | 8/2018 | De Bardonneche | |
| 2019/0254407 | A1 | 8/2019 | Scalciarini et al. | |

FOREIGN PATENT DOCUMENTS

| | | |
|---|---|---|
| FR | 3032869 | 8/2016 |
| FR | 3044529 | 6/2017 |
| JP | H04-010814 U | 1/1992 |
| JP | 2011-519670 | 8/2013 |
| JP | 2017-521179 | 8/2017 |
| WO | WO 2016/014285 | 1/2016 |
| WO | WO 2017/003506 | 1/2017 |

OTHER PUBLICATIONS

Search Report issued in Int'l Application No. PCT/FR2018/053486 (2019).

* cited by examiner

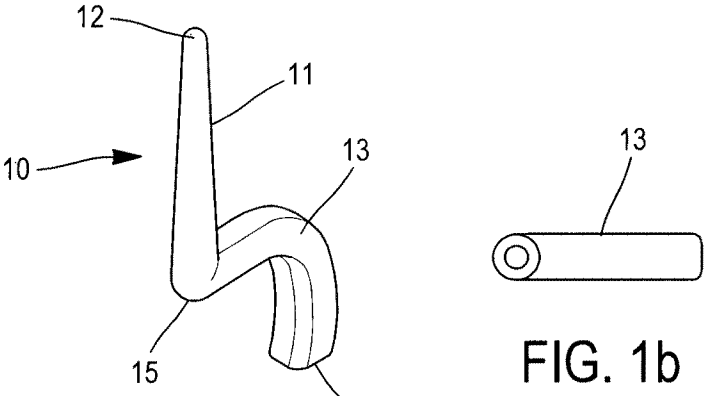
FIG. 1a
FIG. 1b
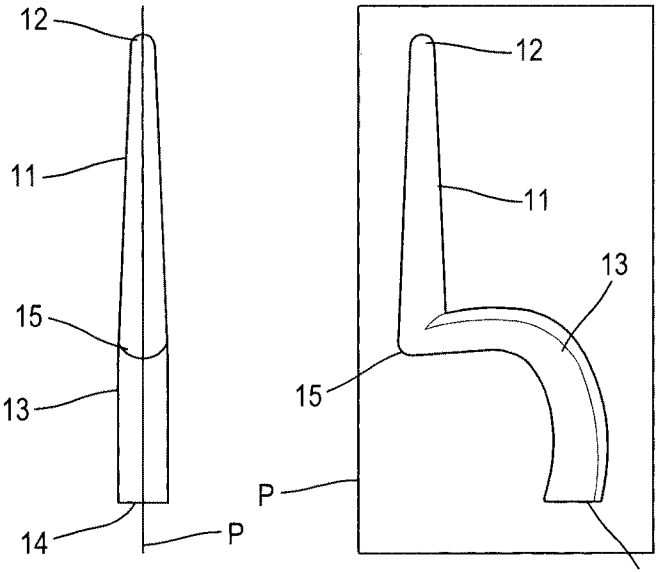
FIG. 1d
FIG. 1c
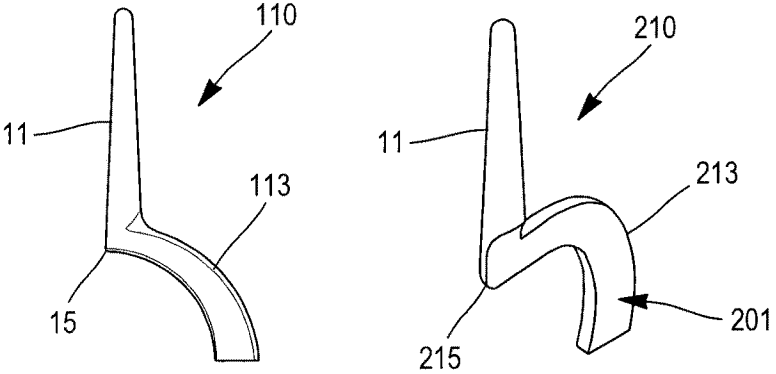
FIG. 2
FIG. 3
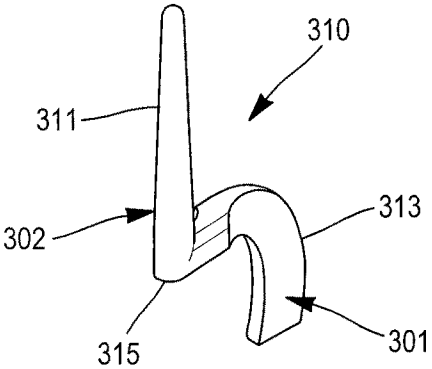
FIG. 4a
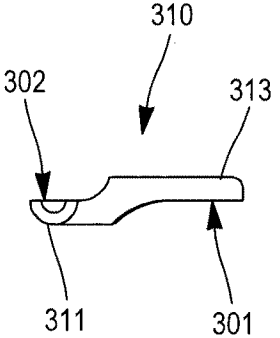
FIG. 4b

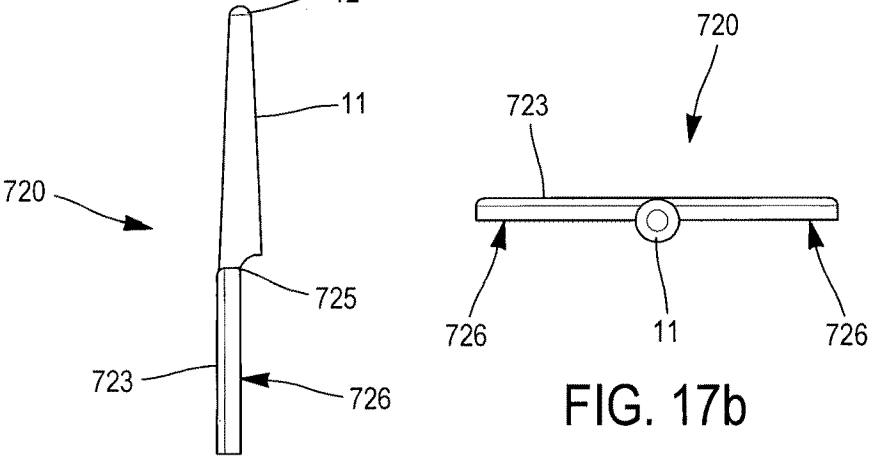
FIG. 17b
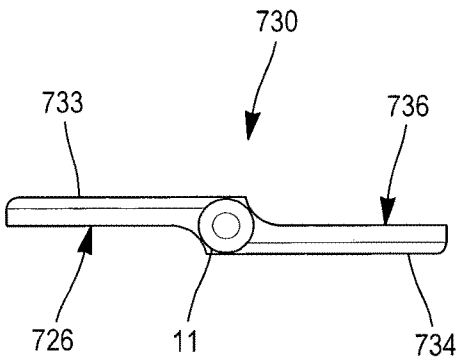
FIG. 17a
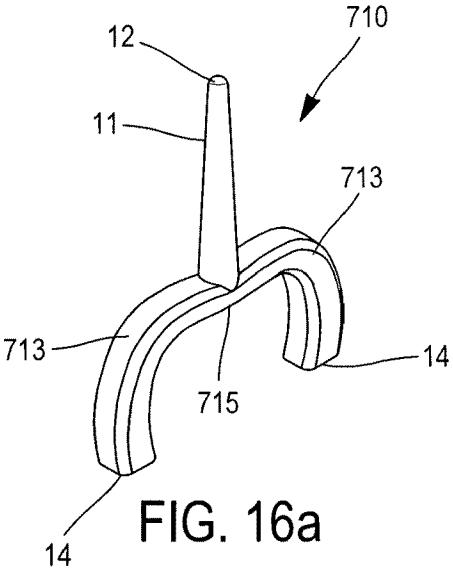
FIG. 16a
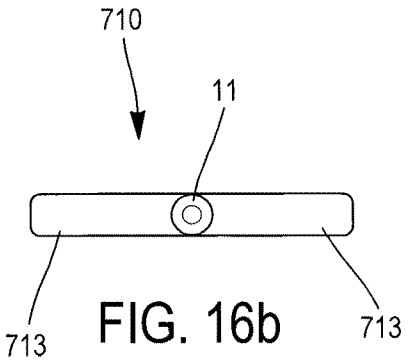
FIG. 16b
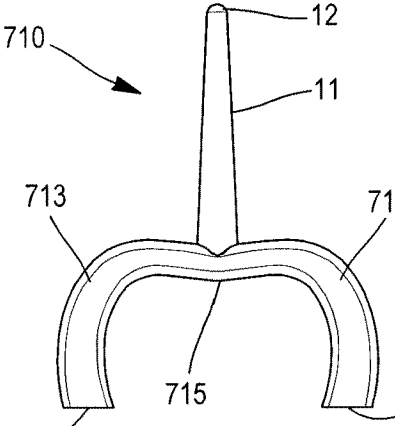
FIG. 16d
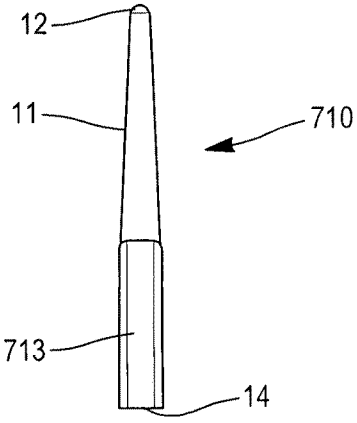
FIG. 16c
FIG. 18

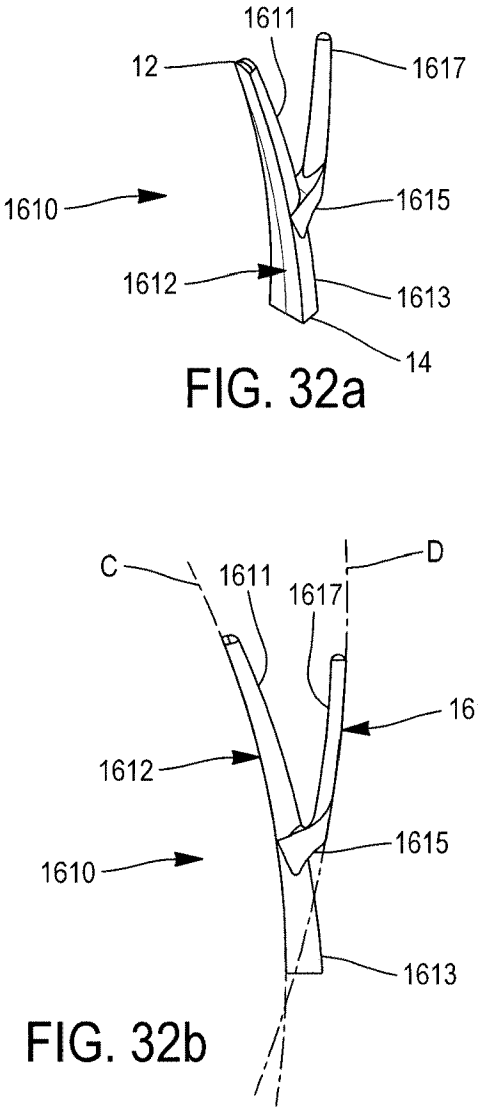
FIG. 32a
FIG. 32b
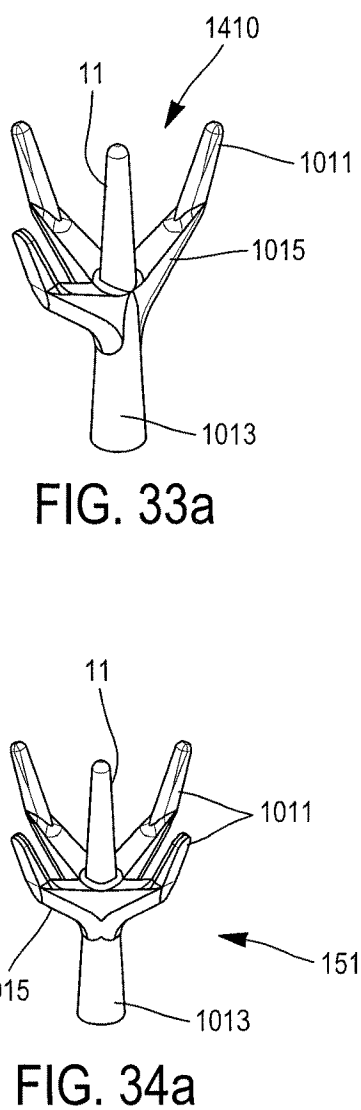
FIG. 33a
FIG. 34a
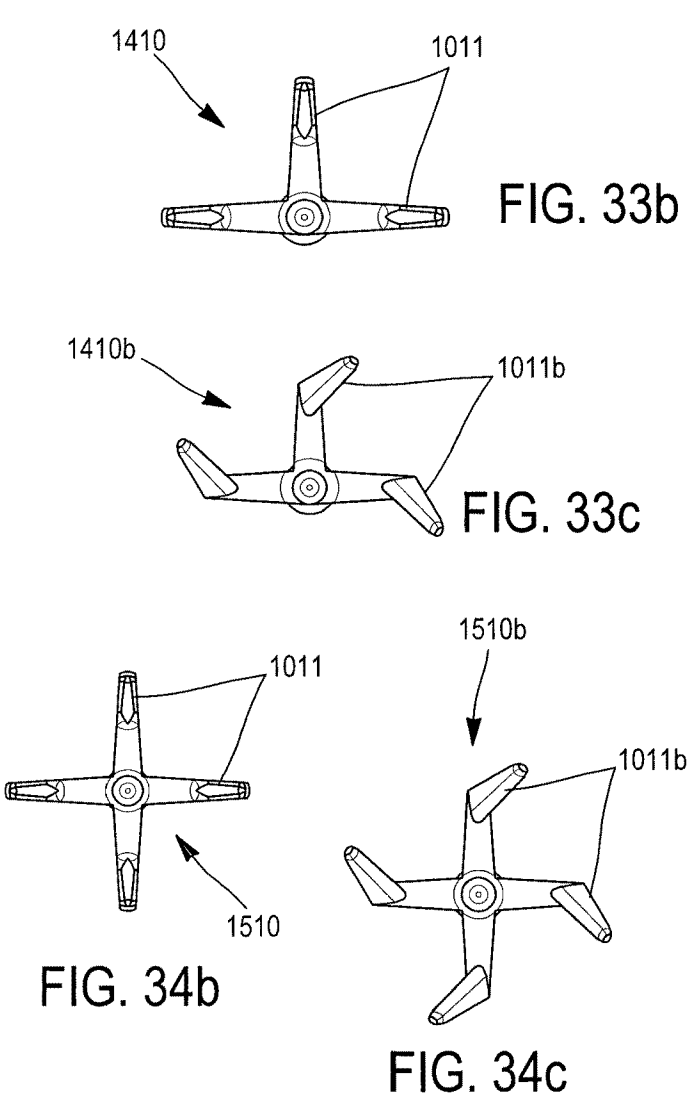
FIG. 33b
FIG. 33c
FIG. 34b
FIG. 34c

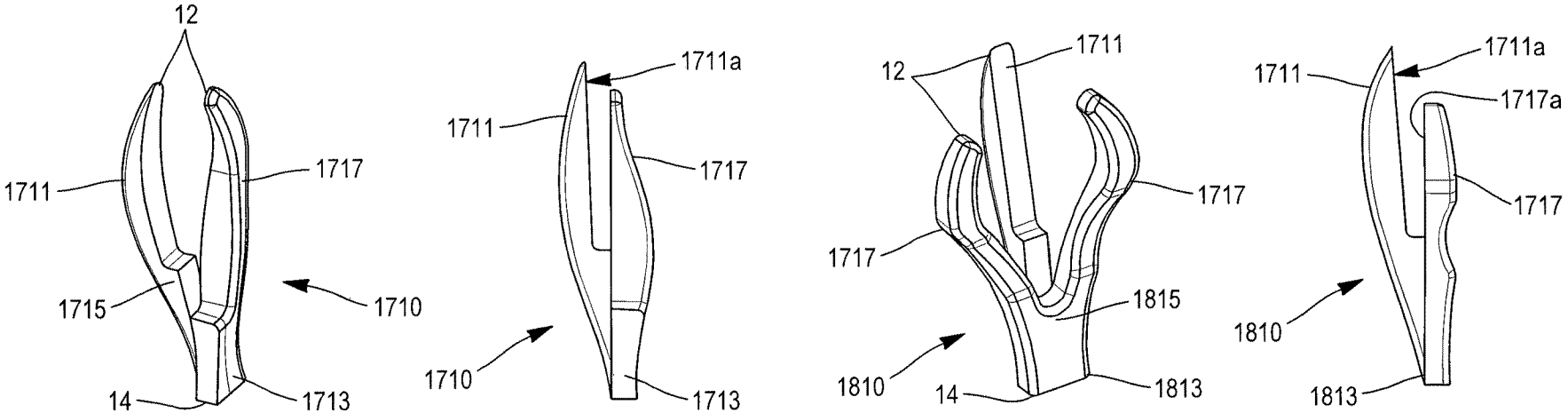
FIG. 35a
FIG. 35b
FIG. 36a
FIG. 36b
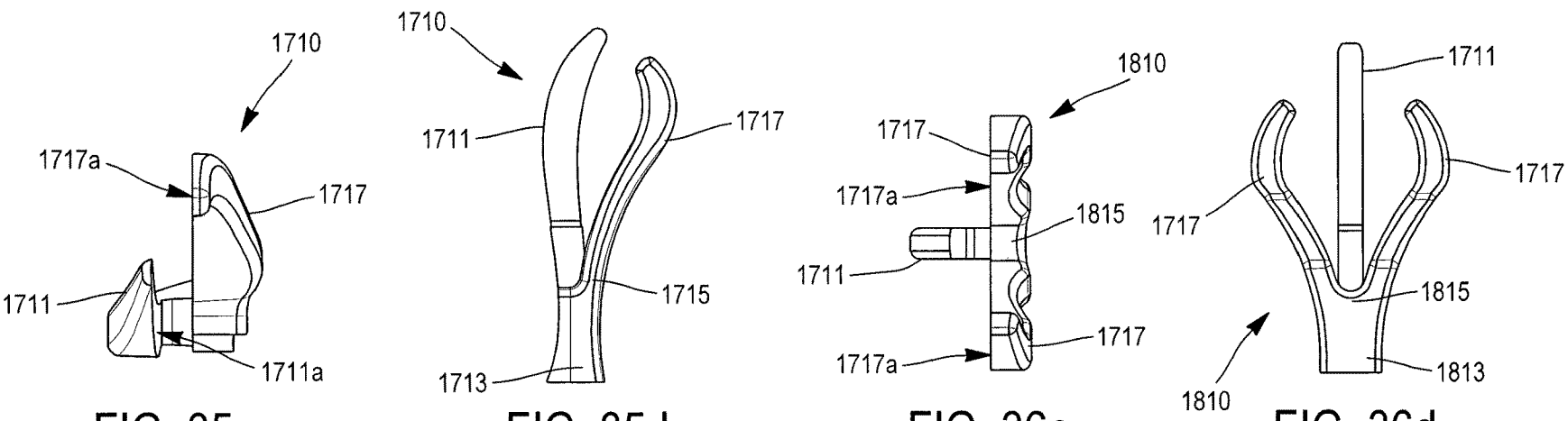
FIG. 35c
FIG. 35d
FIG. 36c
FIG. 36d

DEVICE FOR APPLICATION OF A FLUID PRODUCT

This application is a U.S. nationalization under 35 U.S.C. § 371 of International Application No. PCT/FR2018/053486, filed Dec. 20, 2018, which claims priority to International Application No. PCT/FR2018/052019, filed Aug. 3, 2018, the entire contents of each are incorporated herein by reference.

TECHNICAL FIELD OF THE INVENTION

The invention relates to an applicator device for applying a fluid or pasty product onto keratinous fibers or onto the skin. Notably, the invention relates to an applicator device for applying a cosmetic product, make-up product or care product to the hair, the eyelashes, the eyebrows, the skin or the lips.

STATE OF THE PRIOR ART

There are currently applicator devices for applying a product of fluid or pasty type onto keratinous fibers, such as mascara brushes for example, that comprise a central core of elongate form extending along a longitudinal axis, at least one row of elongate spikes comprising a first end embedded in the core and a free second end. Usually, spikes and the core are formed in a single piece by molding, made of a piece with one another. For example, the document FR 2 937 514 describes such applicator devices. One drawback with this type of production is that the spikes are monolithic and their end embedded in the core has a greater section than a section of the spike at its free end, in particular for technical molding reasons. Because of this, the spike, regardless of the material used, is relatively inflexible. Indeed, the spike will, upon a use of the applicator device, offer a certain resistance when the latter enters into frontal or lateral contact with a keratinous fiber (or skin). Consequently, the spike will poke, for example, the eyelid when making up the eyelashes, or else the skin in an eyebrow treatment, or else the lips or the scalp, etc.

A first solution to this issue of comfort is provided by the document US2012/0170965 which describes a spike comprising a conical anchoring end of section that is still as great as previously, and a very flexible free end which can be bent back so that the point does not poke the skin. However, this solution presents two drawbacks. The first is that the flexibility of the free end and the fact that it is bent back no longer allow the keratinous fibers to be disentangled during an application. The other drawback is that, the base of spike being rigid, the product present between the rigid bases of the spike cannot rise to the free end of the spikes to be applied to the keratinous fibers or the skin.

SUMMARY OF THE INVENTION

One aim of the invention is to provide an applicator device for applying a fluid or pasty product that allows for an optimal application of the product while obtaining a feeling of enhanced comfort for its user.

To this end, there is provided, according to the invention, an applicator device for applying a fluid or pasty product to keratinous fibers or to the skin (epidermis), comprising an elongate core extending along a longitudinal axis X and of longitudinal cylindrical form, a plurality of spikes distributed on said core, each spike extending from an anchoring end in the core to a free end and being made of a piece with said core, characterized in that each spike comprises, from the anchoring end to the free end, a proximal stage, a bridge and a distal stage, at least one out of the proximal stage and the bridge forming a flexible link.

Thus, such a structure of the spike makes it possible to retain a distal stage that is sufficiently rigid to allow the keratinous fibers to be disentangled while guiding them, the flexible link formed by the proximal stage and/or the bridge serving as damper making it possible to erase the poking sensation when the free end of the spike comes into contact with the underlying skin. The deformation thus obtained in use at the base of the spike allows the product present at this point to rise to the free end of the spike.

Advantageously, but optionally, the applicator device according to the invention has at least one of the following technical features:

- the proximal stage forms the flexible link between the anchoring end and the bridge;
- the bridge forms the flexible link between the proximal and distal stages;
- the proximal stage has an incurved form, notably a circular arc;
- the spike comprises a flexible foot extending between the bridge and the core and supporting the distal stage;
- the proximal stage comprises a flexible arch comprising two feet, the bridge being situated in a middle of the arch;
- two adjacent spikes each comprising a flexible arch, the two adjacent flexible arches comprise a foot common to one another;
- the common foot extends at a distance from an outer surface of the arch;
- the distal stage comprises a main extension and at least one secondary extension;
- the secondary extension extends protruding from the main extension;
- the secondary extension extends protruding from the bridge;
- the distal stage comprises two to four secondary extensions;
- each of the secondary extensions extends protruding from a flexible link-forming independent associated bridge;
- the core is hollow;
- the core comprises a longitudinal slit parallel to the longitudinal axis X;
- the applicator device comprising a support, the core can be developed so as to be received on the support;
- the support comprises a duct for bringing product to an end of the support or through the hollow core;
- the device further comprises means for implementing a flow for the product P in the duct;
- the spikes are distributed on the core in adjacent rows, the spikes of one and the same row being oriented in the same way and the spikes of an adjacent row being oriented differently; and
- the spikes of the adjacent row are oriented at 90° or at 180°.

BRIEF DESCRIPTION OF THE FIGURES

Other features and advantages of the invention will emerge on reading the following description of an embodiment of the invention. In the attached drawings:

FIG. 1 presents three-dimensional, front, profile and plan views of a first embodiment of a spike of an applicator device according to the invention;

FIGS. 2 to 14 are views illustrating variant embodiments of the spike of FIG. 1;

FIG. 16 presents three-dimensional, front, profile and plan views of a second embodiment of a spike of an applicator device according to the invention;

FIGS. 17 and 18 are views illustrating variant embodiments of the spike of FIG. 16;

FIGS. 26 to 36 are views illustrating variant embodiments of the spike of FIG. 25;

For greater clarity, the elements that are identical or similar are identified by identical reference symbols throughout the figures.

DETAILED DESCRIPTION OF AN EMBODIMENT

Figure 15:
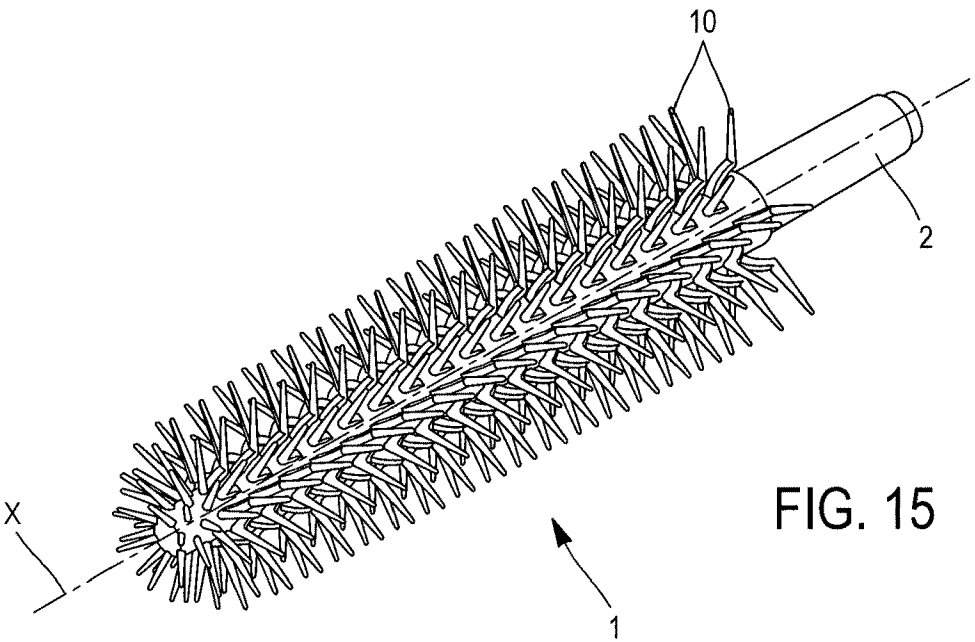
FIG. 15 is a three-dimensional view of an embodiment of an applicator device according to the invention comprising a plurality of spikes of FIG. 1.

Referring to FIG. 15, a first embodiment of an applicator device 1 according to the invention will now be described. The applicator device 1 according to the invention is, here, a mascara brush. Here it comprises a core 2 which extends longitudinally along a longitudinal axis X. The core 2 can have a cross section that is constant or not over a length. In the most common embodiments, either the cross section is constant, or the cross section decreases from a proximal end engaged with a tube and/or a gripping shaft to a distal free end. Generally, the core 2 is of overall cylindrical form, preferably of revolution of axis the longitudinal axis X. Thus, the cross section of the core 2 can have a circular, polygonal, oval or other form. It can be axisymmetrical. The core 2 can be solid or hollow. The person skilled in the art will choose the most appropriate core according to economic and/or technical constraints.

Also, the applicator device 1 according to the invention comprises a plurality of spikes 10 distributed on the core 2. The spikes 10 extend protruding from an outer peripheral surface of the core 2. The spikes 10 are, for example, made of a piece with the core 2. Notably, the spikes 10 are obtained from molding with the core 2. Here, as illustrated, the spikes 10 are distributed in adjacent rows pairwise extending longitudinally parallel to the longitudinal axis X. The spikes 10 of one and the same row extend in the same way according to a same orientation, parallel to one another, from the core 2. Here, in considering two adjacent rows, the spikes 10 of one of the adjacent rows are oriented differently from the spikes 10 of the other of the adjacent rows, for example, as illustrated in FIG. 15, at 180°. As a variant, the orientation is 90°.

Referring to FIG. 1, there now follows a more detailed description of a first embodiment of a spike 10 for an applicator device 1 according to the invention. The spike 10 comprises an anchoring end 14 and a free end 12. The anchoring end 14 is linked to the core 2 of the applicator device 1 according to the invention. The spike 10 therefore extends from the anchoring end 14 to the free end 12, here in a plane P of symmetry. From the anchoring end 14, the spike 10 comprises a proximal stage 13 followed by a bridge 15 then a distal stage 11 terminated by the free end 12. The bridge 15 serves as a junction between the proximal 13 and distal 11 stages. The distal stage 11 here comprises a main extension of tapered form. The proximal stage 13 is, here, of incurved form like a cross, an apex of which is, here, situated at a distance from the bridge 15 which is then located at a height lower than that of the apex. As a variant, the bridge 15 is situated at the level of the apex of the incurved form of the proximal stage 13. This incurved form of the proximal stage 13 makes it possible to give the proximal stage 13 a certain flexibility. Thus, the proximal stage 13 forms a flexible link between the anchoring end 14 (and therefore the core 2 of the applicator device 1 according to the invention) and the bridge 15.

According to different variant embodiments, the bridge 15 being positioned on a free end of the incurved form of the proximal stage 13, this free end of the incurved form of the proximal stage 13 forms an apron in a direction which can be parallel to the axis X (that is to say that the bridge 15 is situated at the level of the apex of the incurved form of the proximal stage 13), or else in a direction which brings it closer to the axis X (the bridge 15 is situated at a lower height than that of the apex of the incurved form of the proximal stage 13), or else, on the contrary, in a direction which moves it away from the axis X.

According a variant embodiment of the spike 10, illustrated in FIG. 2, the proximal stage 113 of the spike 110 is in the form of a circular arc of the order of a quarter circular arc.

According to a second variant embodiment of the spike 10, illustrated in FIG. 3, the proximal stage 213 of the spike 210 is made thinner and has a flat face 201 contained in the plane P of symmetry. This flat face 201 is continued in the bridge 215 providing the latter with a certain flexibility that is added to that of the proximal stage 213. Once again, as for the bridge 15, according to different variant embodiments, the bridge 215 being positioned on a free end of the incurved form of the proximal stage 213, this free end of the incurved form of the proximal stage 213 forms an apron in a direction which can be parallel to the axis X (that is to say that the bridge 215 is situated at the level of the apex of the incurved form of the proximal stage 213), or else in a direction which brings it closer to the axis X (the bridge 215 is situated at a lower height than that of the apex of the incurved form of the proximal stage 213), or else, on the contrary, in a direction which moves it away from the axis X.

According to a third variant embodiment of the spike 10, illustrated in FIG. 4, the proximal stage 313 of the spike 310 is made thinner as previously and has a flat face 301 contained in the plane P of symmetry. Also, the distal stage 311 is, for its part, made thinner and has a flat face 302 also contained in the plane P of symmetry. The arrangement is such that the proximal stage 313 extends on one side of the plane P of symmetry whereas the distal stage 311 extends on the other side of the plane P of symmetry. Also, the flat face 302 is continued in the bridge 315 providing the latter with a certain flexibility that is added to that of the proximal stage 313. Once again, as for the bridge 15,215, according to different variant embodiments, the bridge 315 being positioned on a free end of the incurved form of the proximal stage 313, this free end of the incurved form of the proximal stage 313 forms an apron in a direction which can be parallel to the axis X (that is to say that the bridge 315 is situated at the level of the apex of the incurved form of the proximal stage 313), or else in a direction which brings it closer to the axis X (the bridge 315 is situated at a lower height than that of the apex of the incurved form of the proximal stage 313), or else, on the contrary, in a direction which moves it away from the axis X.

Figure 5A:
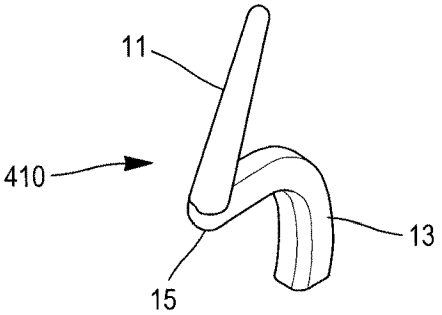
Figure 6:
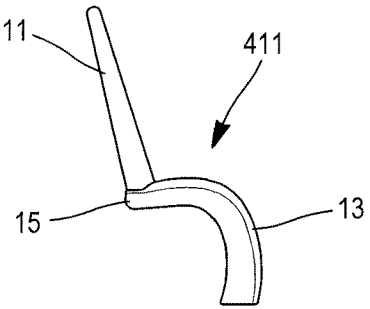
Figure 5B:
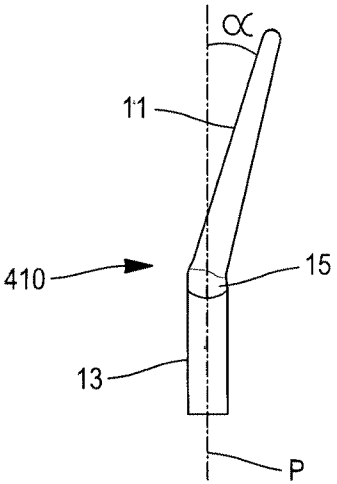

FIG. 5 illustrates a fourth variant embodiment of the spike 10. The spike 410 is differentiated from the spike 10 in that it comprises a distal stage 11 of which the main extension is oriented so as to form an angle α with the plane P of symmetry. In a variant 411 illustrated in FIG. 6, the main extension is in the plane P of symmetry but at an angle with a vertical. More generally, in this variant embodiment, the main extension has an orientation contained within a cone of angle α at the summit 2, a summit that is situated here at the level of the bridge 15.

Figure 9:
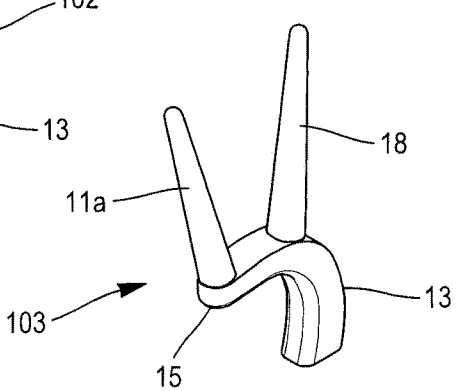
Figure 8:
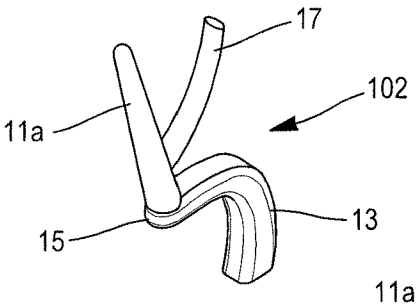
Figure 7:
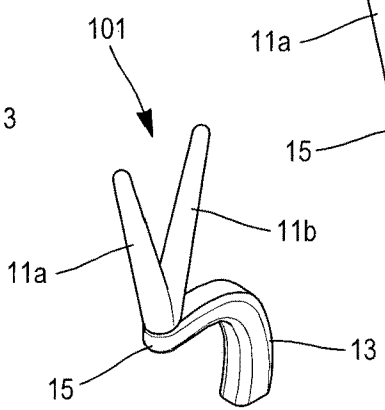

In FIGS. 7 to 9, a fifth variant of the spike 10, and declinations are illustrated. The spike 101 comprises a distal stage comprising a main extension 11*a* and a secondary extension 11*b* extending protruding from the bridge 15 and forming an angle with one another. The spike 102 comprises a distal stage comprising a main extension 11*a* and a secondary extension 17 extending protruding from a lateral wall of the main extension 11*a*. The spike 103 comprises a distal stage comprising a main extension 11*a* and a secondary extension 18 extending protruding from the proximal stage 13.

Figure 12:
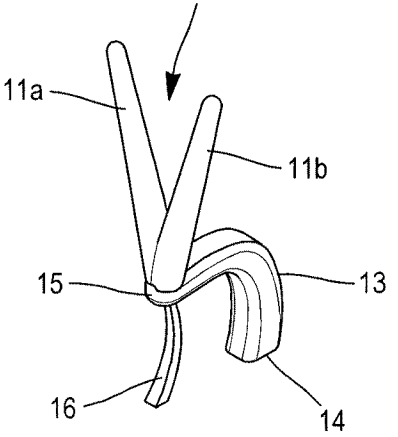
Figure 11:
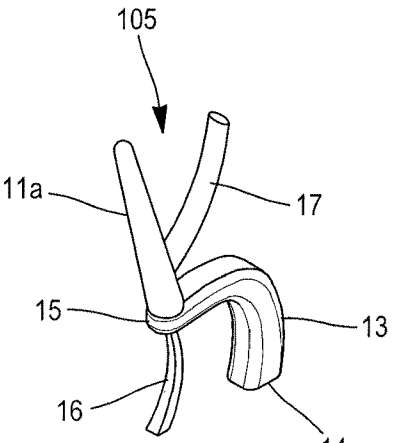
Figure 10:
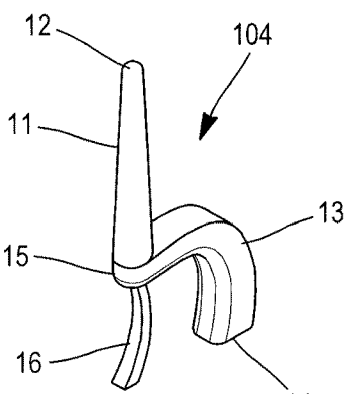

A sixth variant embodiment of the spike 10 is illustrated in FIG. 10. The spike 104 further comprises, at its proximal stage 13, a flexible foot 16 extending between the bridge 15 and the core 2 and supporting the distal stage 11. The flexibility of the flexible foot 16 is such that the proximal stage 13 still forms a flexible link between the bridge 15 and the anchoring end 14 upon pressure on the free end 12 of the spike 104. However, the flexible foot 16 holds the spike 104 while preventing the latter from being elongated or tilting backward when, upon use, the spike 104 comes into contact at its free end 12 with a lip of a squeegee of a tube containing the fluid product and in which the applicator device 1 according to the invention is stored. FIGS. 11 and 12 illustrate variant embodiments 105 and 106 of the spikes 102 and 101 respectively comprising the flexible foot 16.

Figure 13B:
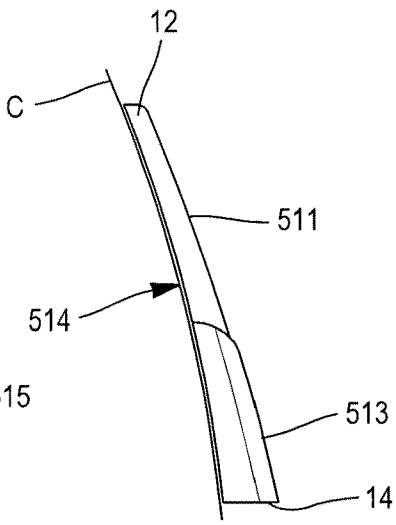
Figure 13A:
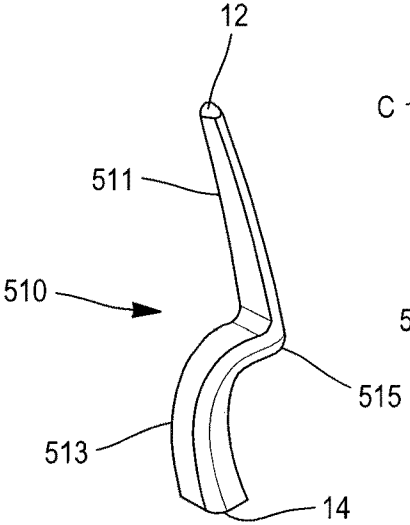

FIG. 13 illustrates a seventh variant embodiment of the spike 10. The spike 510 of this variant comprises, from the anchoring end 14 to the free end 12, the proximal stage 513, the bridge 515 and the distal stage 511. Furthermore, the spike 510 comprise a lateral face 514 extending over the entire height of the spike 510 and bearing on a circle C. The circle C is in a plane which is at right angles to the longitudinal axis X, a point of intersection of the longitudinal axis X with the plane of the circle C and on the circle C. Such a configuration of the circle C supporting a face of the spike is described in detail in the document FR 2 937 514 to which reference can be made for more comprehensive information.

Once again, as for the bridge 15,215,315, according to different variant embodiments, the bridge 515 being positioned on a free end of the incurved form of the proximal stage 513, this free end of the incurved form of the proximal stage 513 forms an apron in a direction which can be parallel to the axis X (that is to say that the bridge 515 is situated at the level of the apex of the incurved form of the proximal stage 513), or else in a direction which brings it closer to the axis X (the bridge 515 is situated at a lower height than that of the apex of the incurved form of the proximal stage 513), or else, on the contrary, in a direction which moves it away from the axis X.

Figure 14B:
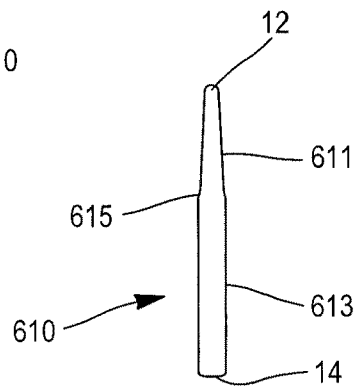
Figure 14A:
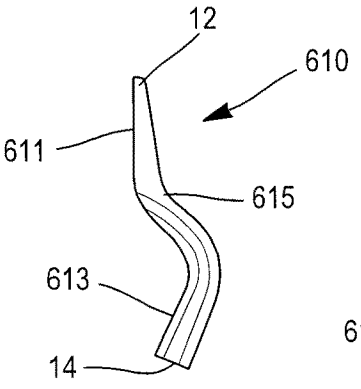

An eighth variant embodiment of the spike 10 is illustrated in FIG. 14. The spike 610 of this variant embodiment comprises, from the anchoring end 14 to the end free 12, the proximal stage 613, the bridge 615 and the distal stage 611. The main difference lies in the fact that the anchoring end 14 is, here, situated substantially vertical to the bridge 615 giving the spike 610 a form similar to a distorted "S" when seen from the side (FIG. 14*a*). When seen from the front (FIG. 14*b*) the spike 610 is contained in the plane P of symmetry.

Figure 38:
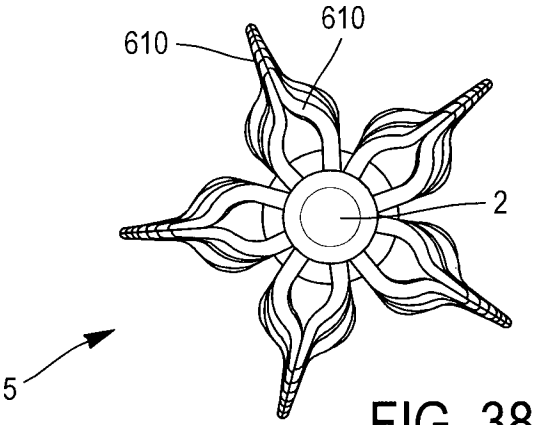
FIGS. 37 and 38 are three-dimensional and front views of an embodiment of an applicator device according to the invention comprising a plurality of spikes of FIG. 14.
Figure 37:
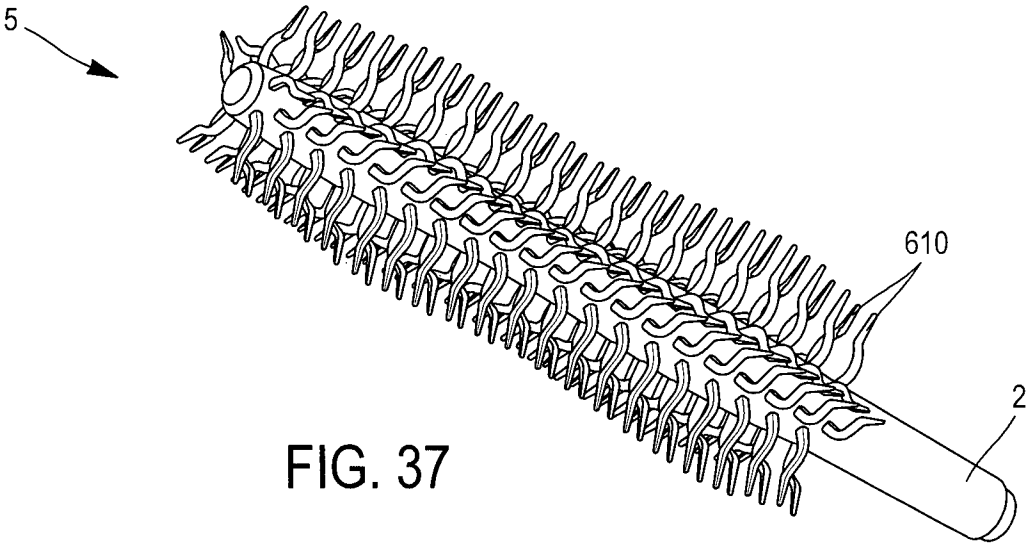

FIGS. 37 and 38 illustrate a layout of a plurality of spikes 610 in an embodiment of an applicator device 5 according to the invention. As indicated previously, the spikes 610 of one and the same row extend in the same way in the same orientation, parallel to one another, from the core 2: here the plane P of symmetry of the spikes 610 is substantially at right angles to the longitudinal axis X. Once again, in considering two adjacent rows, the spikes 610 of one of the adjacent rows are oriented differently from the spikes 610 of the other of the adjacent rows, at 180°, while being offset longitudinally from one adjacent row to another. Thus, in the front view illustrated in FIG. 38, the applicator device 5 according to the invention presents a series of lobes (here five of them) uniformly distributed over a circumference of the core 2.

Figure 40:
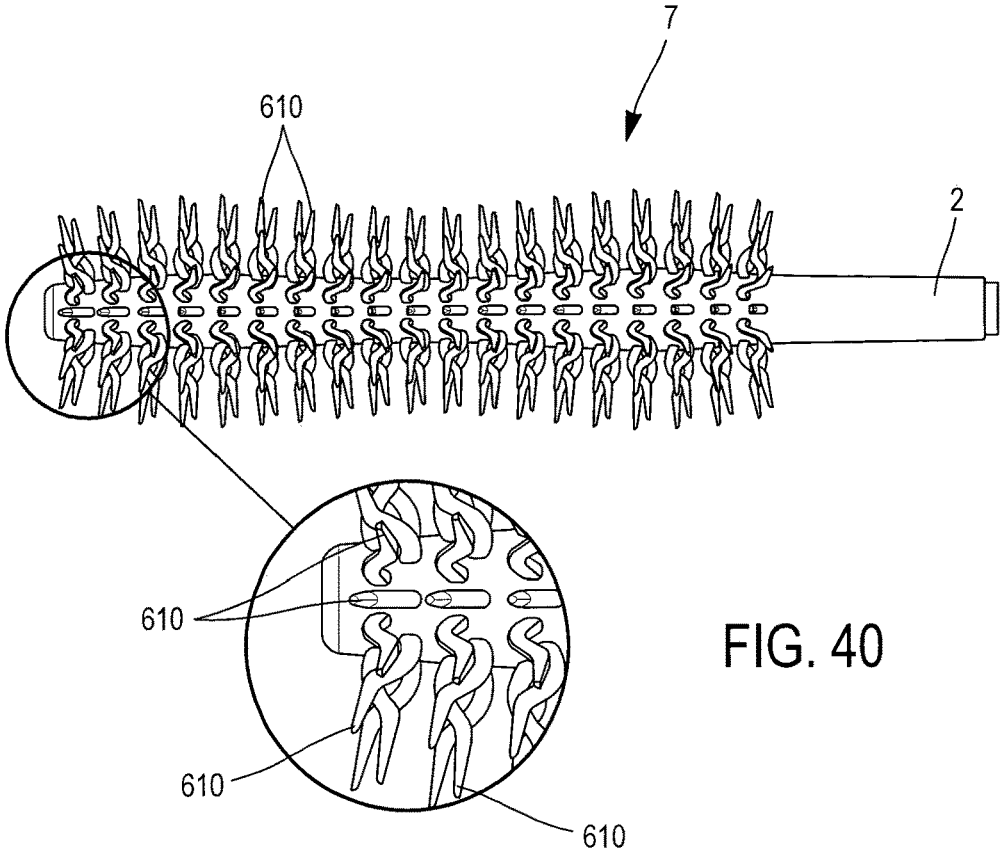
FIG. 40 is a three-dimensional view of an embodiment of an applicator device according to the invention comprising a plurality of spikes of FIG. 14.

FIG. 40 illustrates another layout of a plurality of spikes 610 in an embodiment of an applicator device 7 according to the invention. As indicated previously, the spikes 610 of one and the same row extend in the same way according to the same orientation, parallel to one another, from the core 2: here the plane P of symmetry of the spikes 610 passes substantially through the longitudinal axis X. Once again, in considering two adjacent rows, the spikes 610 of one of the adjacent rows are oriented differently from the spikes 610 of the other of the adjacent rows, at 180°.

Figure 41:
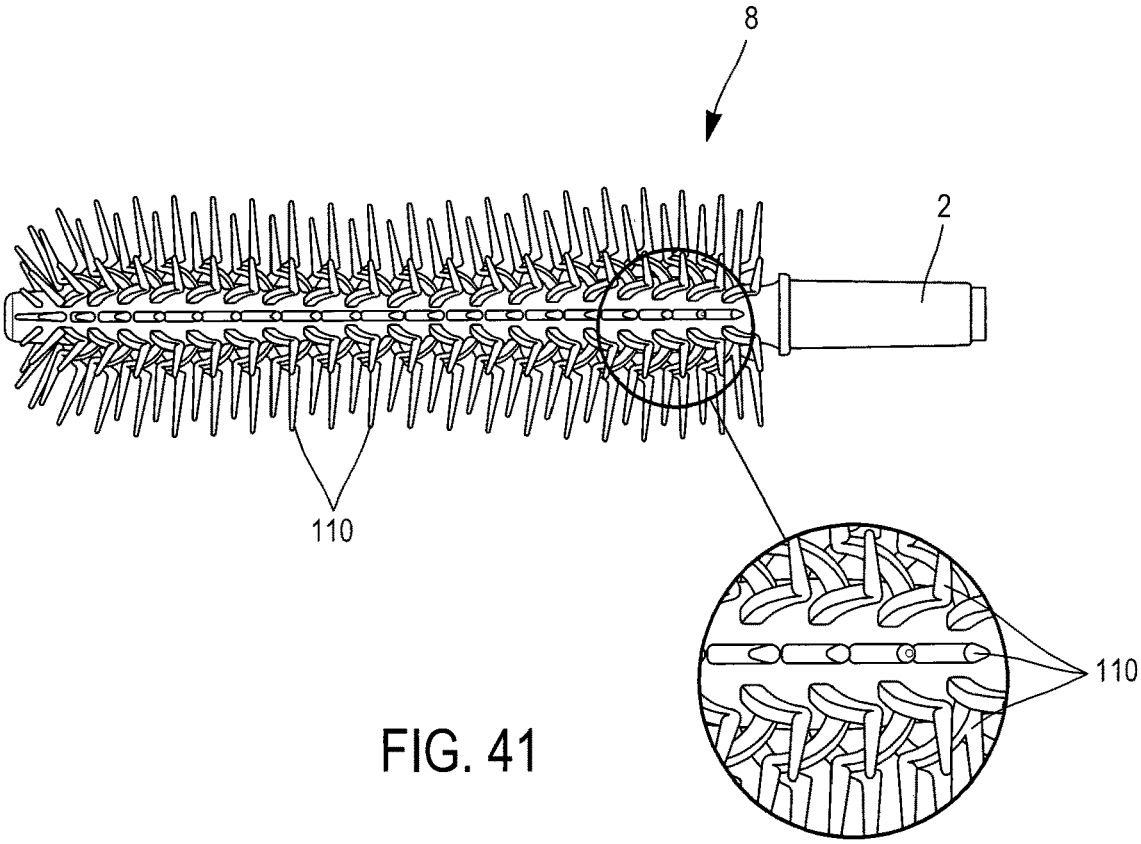
FIG. 41 is a three-dimensional view of an embodiment of an applicator device according to the invention comprising a plurality of spikes of FIG. 2.

FIG. 41 illustrates a similar layout of a plurality of spikes 110 in an embodiment of an applicator device 8 according to the invention.

There now follows a description of a second embodiment of a spike 710 for an applicator device according to the invention with reference to FIGS. 16 to 22. The spike 710 is differentiated from the spike 10 previously described in that the proximal stage comprises an arch produced by two symmetrically incurved forms 713 mirroring one another. Here, each of the incurved forms 713 is similar to the proximal stage 13 of the spike 10 previously described. The bridge 715 is situated at a junction of the two incurved forms 713 each forming an anchoring foot extending from the anchoring end 14. The distal stage 11 extends from the bridge 715 to the free end 12.

In a first variant embodiment illustrated in FIG. 17, the spike 720 comprises a thinner arch 723 which has a flat face 726 contained in the plane P of symmetry. This flat face 726 is continued in the bridge 725 providing the latter with a certain flexibility which is added to that of the proximal stage.

In a second variant embodiment illustrated in FIG. 18, the spike 730 comprises an arch formed by two thinner incurved forms 733 and 734 each of which has a flat face 726 and 736 respectively contained in the plane P of symmetry. The arrangement is such that one 733 of the incurved forms extends on one side of the plane P of symmetry whereas the other 734 of the incurved forms extends on the other side of the plane P of symmetry.

Once again, as for the bridge 15,215,315, according to different variant embodiments, the bridge 715,725 being positioned on a free end of the incurved form of the proximal stage 713,723,733,734, this free end of the incurved form of the proximal stage 713,723,733,734 forms an apron in a direction which can be parallel to the axis X (that is to say that the bridge 715,725 is situated at the level of the apex of the incurved form of the proximal stage 713,723,733,734), or else in a direction which brings it closer to the axis X (the bridge 715,725 is situated at a lower height than that of the apex of the incurved form of the proximal stage 713,723, 733,734), or else, on the contrary, in a direction which moves it away from the axis X.

Figure 21:
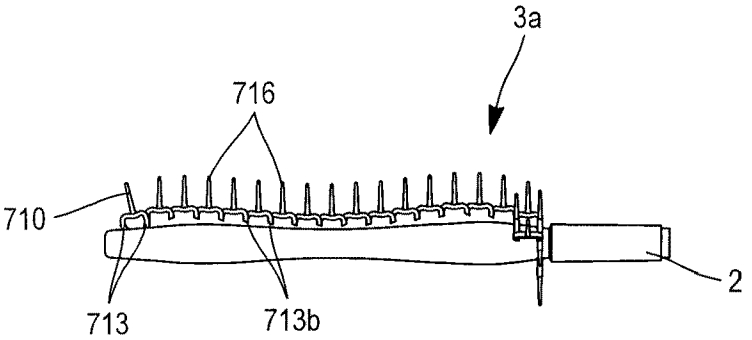
FIGS. 21 and 22 are side views of variant embodiments of the applicator device of FIG. 19.
Figure 22:
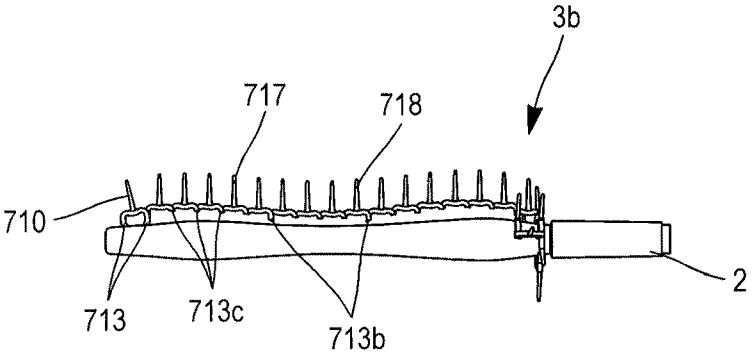
Figure 19:
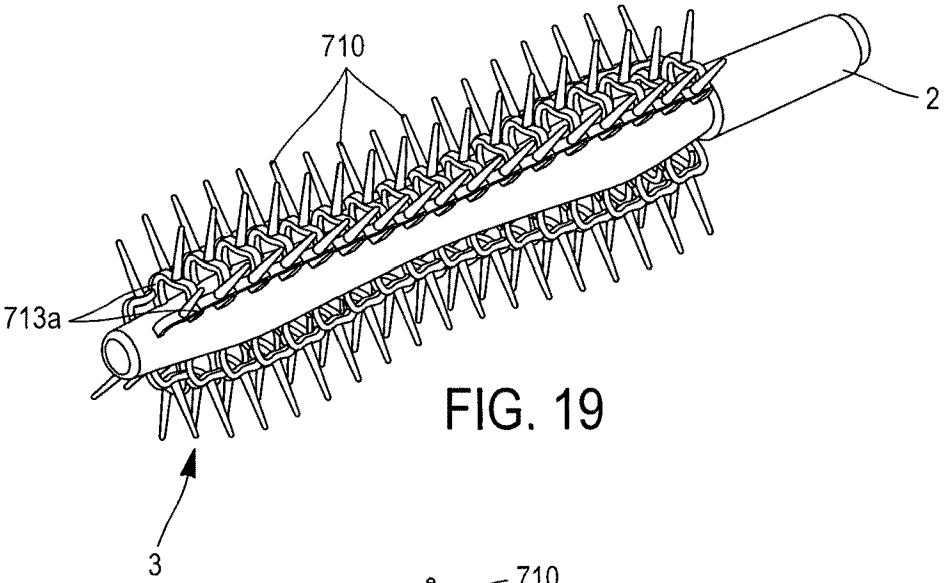
FIGS. 19 and 20 are three-dimensional and front views of an embodiment of an applicator device according to the invention comprising a plurality of spikes of FIG. 16.
Figure 20:
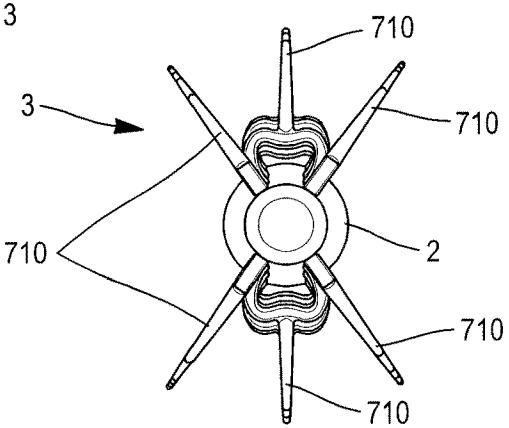
Figure 26:
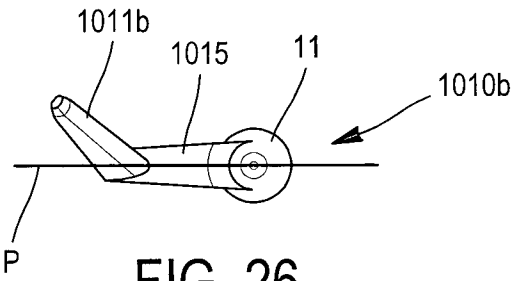
Figure 25B:
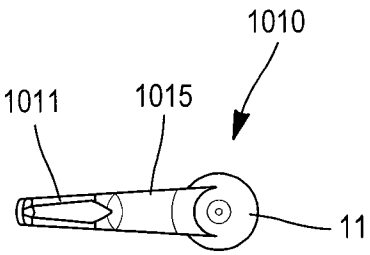
FIG. 25 presents three-dimensional and plan views of a third embodiment of a spike for an applicator device according to the invention.
Figure 25A:
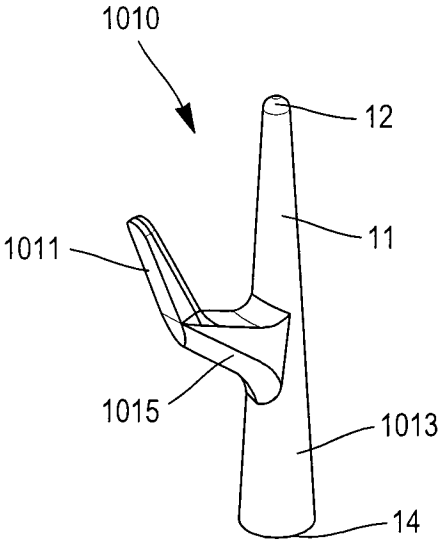

FIGS. 19 and 20 show a layout of a plurality of spikes 710 on an applicator device 3 according to the invention. As indicated previously, the spikes 710 of one and the same row extend in the same way according to the same orientation, parallel to one another, from the core 2. For example, the rows from top to bottom comprise spikes 710 in which the plane P of symmetry is substantially at right angles to the longitudinal axis X, whereas the spikes 710 of the rows adjacent to these two rows from top to bottom are oriented at 90°, their plane P of symmetry passing substantially through the longitudinal axis X of the core 2. Also, the spikes 710 are arranged such that three adjacent spikes 710, one from the top row and two from one of the adjacent rows, have a common anchoring foot 713*a*. In a variant embodiment, this common anchoring foot 713*b* is shortened so that, at rest, it extends at a distance from and facing a peripheral surface of the core as illustrated in FIG. 21 on an applicator device 3*a* according to the invention. In this case, the anchoring foot 713*b* serves as bearing abutment making it possible to modify the flexibility of the spikes 716 that have this common anchoring foot 713*b* in the course of use of the applicator device 3*a* according to the invention. In another variant embodiment of the applicator device 3*b* according to the invention illustrated in FIG. 22, the common anchoring foot 713*c* is reduced to a simple junction between the spikes 718. It is possible to mix the common anchoring feet 713*a*, 713*b* and 713*c* with the spikes 710, 716, 717 and 718 in one and the same layout. That makes it possible to modulate the flexibility of the spikes of the applicator device according to the invention.

There now follows a description of a third embodiment of a spike for an applicator device 4 according to the invention, with reference to FIGS. 23 to 26. The spike 1010 comprises, from the anchoring end 14, a proximal stage 1013, a bridge 1015 and a distal stage 11,1011 extending to the end free 12. The distal end here comprises a main extension 11 extending from the bridge 1015 and a secondary extension 1011 extending from the bridge 1015 along and at a distance from the main extension 11. Here, it is the bridge 1015 which forms the flexible link between the proximal 1013 and distal 11,1011 stages. The secondary extension 1011 forms an angle in the plane P of symmetry with the main extension 11. In a variant of the spike 1010*b*, illustrated in FIG. 26, the secondary extension 1011*b* also forms an angle with the plane P of symmetry.

Figure 23:
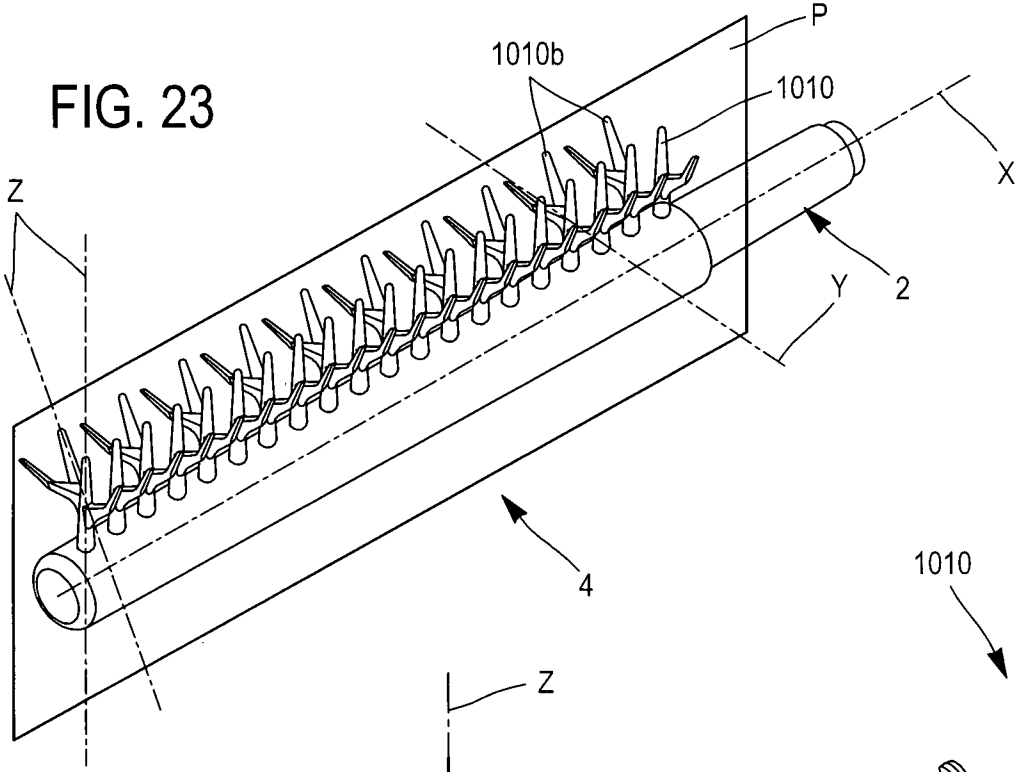
FIGS. 23 and 24 are three-dimensional and front views of an embodiment of an applicator device according to the invention comprising a plurality of spikes of FIGS. 25 and 26.
Figure 24:
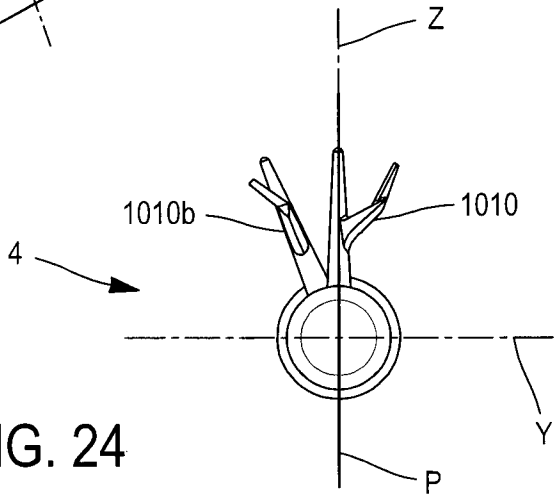

In FIGS. 23 and 24, a layout of a plurality of spikes 1010 and 1010*b* in an embodiment of an applicator device 4 according to the invention is represented. Here, the spikes 1010 form a first longitudinal row whereas the spikes 1010*b* form a second longitudinal row adjacent to the first. Here, the spikes 1010 are oriented in the same direction, their plane P of symmetry being at right angles to the longitudinal axis X, and the spikes 1010*b* are oriented at 90° with respect to the spikes 1010, their plane P of symmetry passing through the longitudinal axis X. Other layouts are possible deriving from those already described previously in relation to other embodiments of the spikes.

Figure 28:
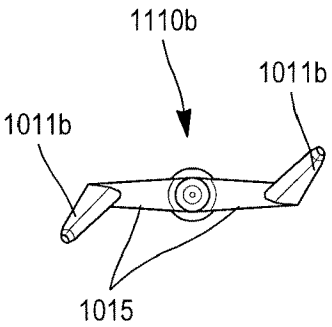
Figure 27A:
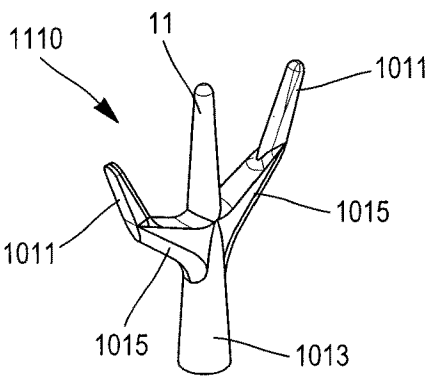
Figure 27B:
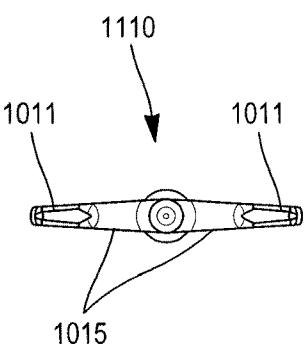

FIGS. 27 and 28 illustrate a variant 1110 of the spike 1010 and a variant 1110*b* of the spike 1010*b*. These variants comprise a second secondary extension, respectively 1011 and 1011*b*, symmetrical to the first secondary extension described previously.

Figure 29:
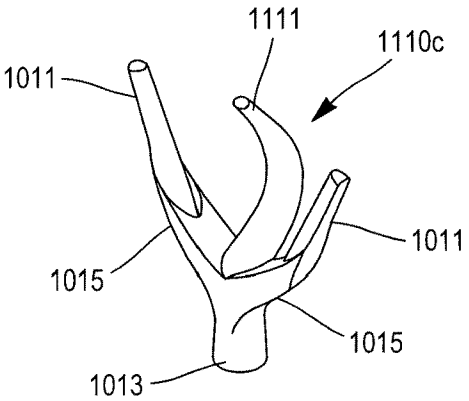

In FIG. 29, the variant embodiment 1110*c* is differentiated from the preceding two, and in particular from the spike 1110, by the fact that the main extension 1111 is not tapered, but is incurved.

Figure 31B:
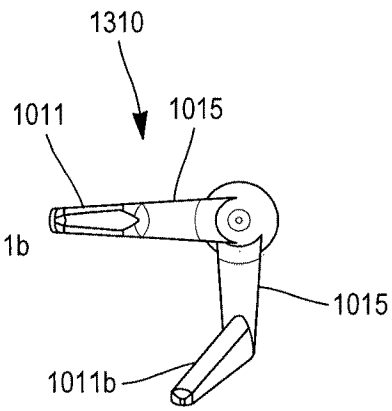
Figure 31A:
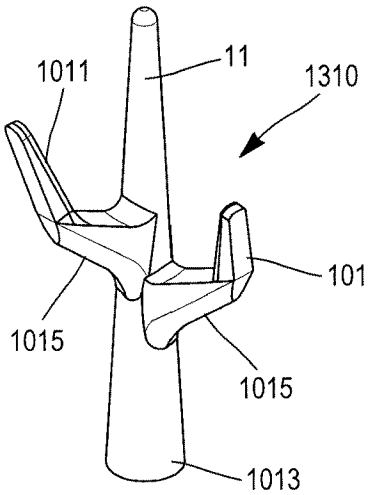
Figure 30B:
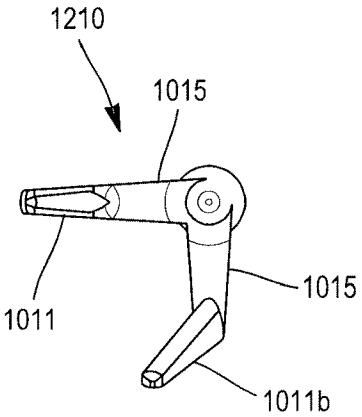
Figure 30A:
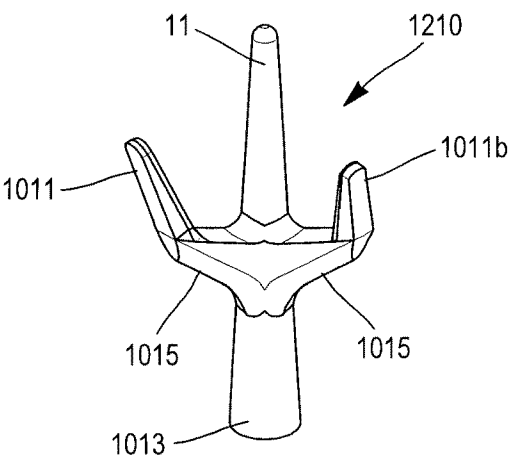

In FIG. 30, the spike 1210 is a variant embodiment of the spikes 1110 and 1110*b* in which the secondary extensions 1011 and 1011*b* are at 90° to one another. In FIG. 31, the spike 1310 is a variant embodiment of the spike 1210 in which the secondary extensions 1011 and 1011*b* are located on the bridge 1015 offset heightwise: thus, each of the secondary extensions 1011, 1011*b* extends protruding from an associated independent flexible bridge 1015.

FIG. 33 illustrates a version 1410, 1410*b* of the spike comprising three secondary extensions 1011, 1011*b*. FIG. 34, for its part, illustrates a version 1510, 1510*b* of the spike comprising four secondary extensions 1011, 1011*b*. The different secondary extensions can be distributed uniformly or not around the main extension 11.

FIG. 32 represents another variant embodiment of the spike 1010. The spike 1610 of this variant comprises, from the anchoring end 14 to the free end 12, the proximal stage 1613, the bridge 1615 and the distal stage 1611, 1617. The distal stage comprises a main extension 1611 and a secondary extension 1617 extending from the bridge 1615 along and at a distance from the main extension 1611. Furthermore, the spike 1610 comprises a first lateral face 1612 extending over the entire height of the spike 1610, along the proximal stage 1613, the bridge 1615 and the main extension 1611 and bearing on a circle C. The circle C is in a plane which is at right angles to the longitudinal axis X, a point of intersection of the longitudinal axis X with the plane of the circle C and on the circle C. Such a configuration of the circle C supporting a face of the spike is described in detail in the document FR 2 937 514 to which reference can be made for more comprehensive information. Also, the secondary extension 1617 comprises a second lateral face 1618 oriented in a direction opposite the first face 1612 and which bears on a circle D.

Figure 39:
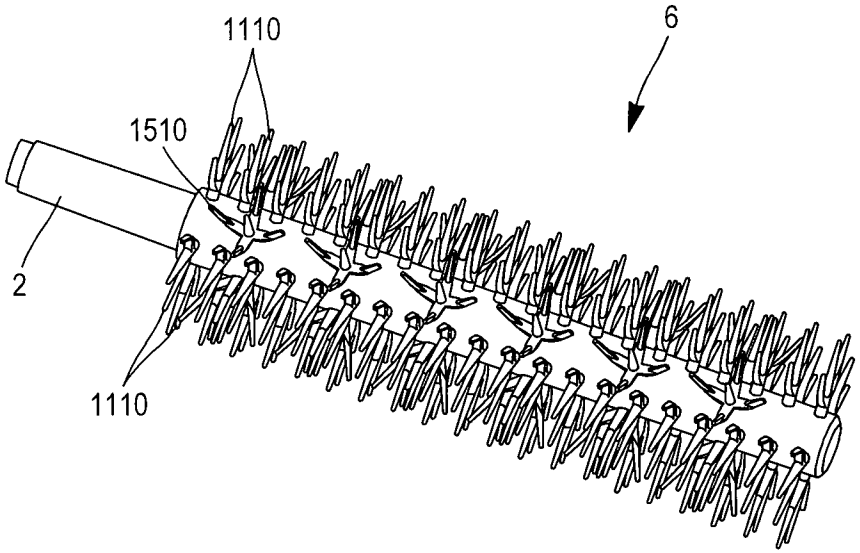
FIG. 39 is a three-dimensional view of an embodiment of an applicator device according to the invention comprising a plurality of spikes of FIGS. 27 and 34.

An applicator device 6 according to the invention is illustrated in FIG. 39 comprising a layout of a plurality of spikes 1110 and 1510. The layout comprises longitudinal rows of spikes 1510, each of these rows being surrounded on either side with longitudinal adjacent rows comprising spikes 1110.

FIG. 35 illustrates another variant embodiment of a spike 1710 for an applicator device according to the invention. The spike 1710 comprises, from the anchoring end 14, a proximal stage 1713, a bridge 1715 and a distal stage 1711,1717 extending to the free end 12. The distal stage comprises a main extension 1717 extending in line with the proximal stage 1713 via the bridge 1715. The main extension 1717 comprises an internal flat face 1717*a* situated in the plane P of the spike 1710. The distal stage further comprises a secondary extension 1711 which extends along and at a distance from the main extension 1717. The secondary extension 1711 comprises a flat internal face 1711*a* which is not concomitant with the plane P and extends facing and at a distance from the latter.

FIG. 36 illustrates yet another variant embodiment of a spike 1810 for an applicator device according to the invention. The spike 1810 comprises, from the anchoring end 14, a proximal stage 1813, a bridge 1815 and a distal stage 1711,1717 extending to the free end 12. The distal stage comprises a main extension with two branches 1717, mirrorwise symmetrical to one another, extending in line with the proximal stage 1813 via the bridge 1815. The branches 1717 comprise an internal flat face 1717*a* situated in the plane P of the spike 1810. The distal stage further comprises a secondary extension 1711 which extends along and at a distance from the main extension. The secondary extension 1711 comprises a flat internal face 1711*a* which is not concomitant with the plane P and extends facing and at a distance from the latter.

The extensions 1717 and/or 1711 extend vertically in the figures either rectilinearly, or in an incurved manner along a single curve or along several curves.

Hitherto, applicator devices according to the invention have been described in a primarily mascara brush or the like version. Other forms are necessary for applications directed toward the epidermis (skin, lips).

Figure 43A:
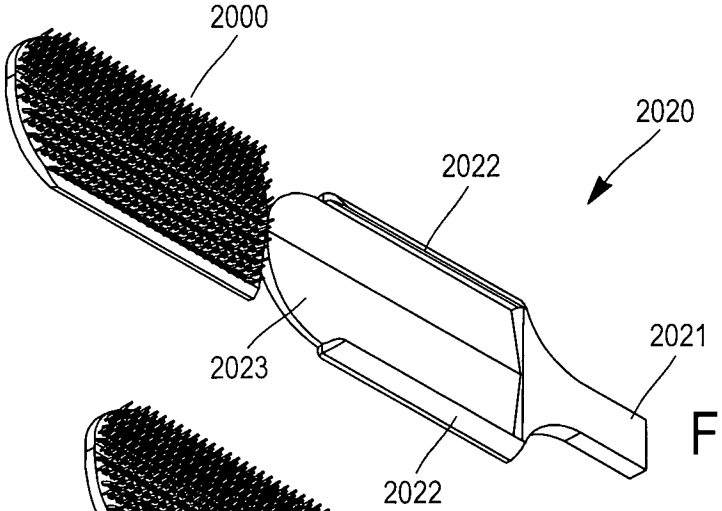
FIG. 43 presents three-dimensional front views of a mounting of the core of FIG. 42 on a first embodiment of an associated support of an applicator device according to the invention.
Figure 43B:
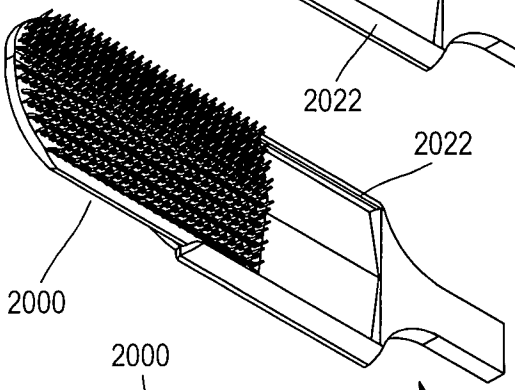
Figure 43C:
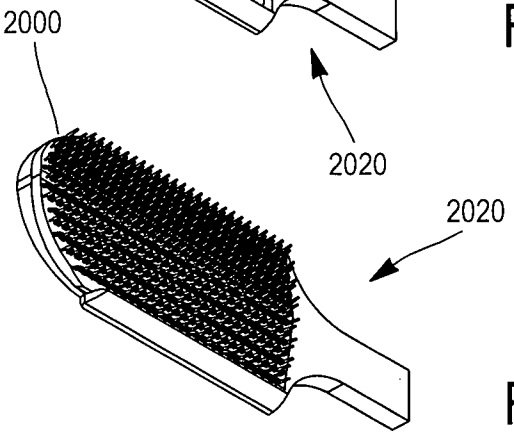
Figure 42A:
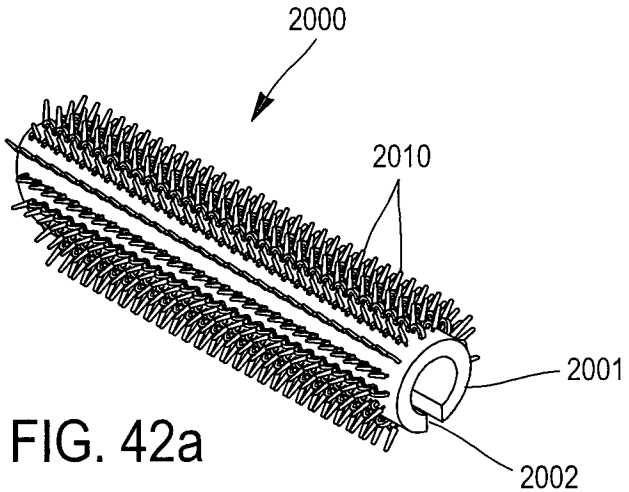
FIG. 42 presents three-dimensional views of a first embodiment of a developable hollow core.
Figure 42B:
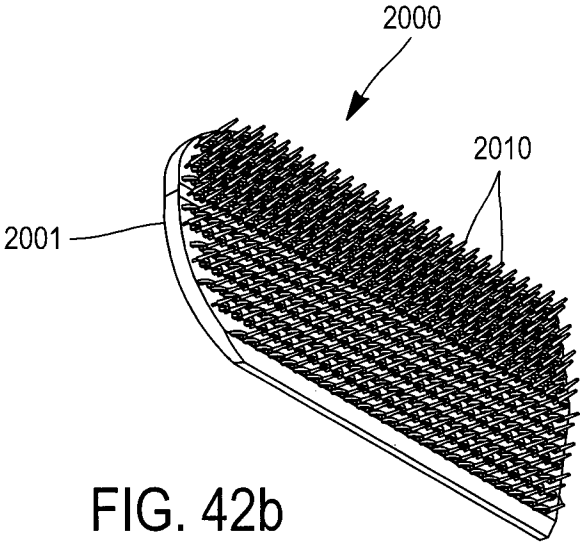

Referring to FIGS. 42 and 43, there now follows a description of another embodiment of an applicator device 2020 according to the invention. This applicator device 2020 according to the invention comprise a core 2000 which is hollow comprising a tube 2001 comprising a longitudinal slit 2002. An outer surface of the tube 2001 comprises a layout of spikes 2010 which can have the structure of one of the spikes described previously. Such a structure of the core 2000 allows it to be made developable so as to become flat as illustrated in FIG. 42*b*. That makes it possible to mold such a core comprising complex spikes in its substantially cylindrical tube form allowing for a mold-stripping of said complex spikes, like those described previously, or others, which is very difficult to do, even impossible, directly in a flat and/or developed form of said core.

The applicator device 2020 according to the invention further comprises a support 2021 comprising a receiving housing 2023 bordered on either side by runners 2022. The core 2000, once developed, is introduced into the housing 2023 by sliding it along the runners 2022. Ultimately, the applicator device 2020 according to the invention forms a spatula for the application of a fluid or pasty product on an epidermis.

Figure 44A:
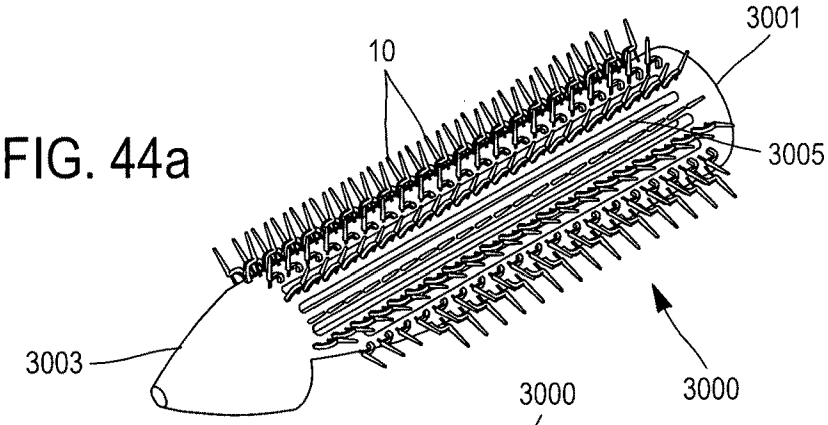
FIG. 44 presents three-dimensional, front and side views of a second embodiment of a developable hollow core.
Figure 44B:
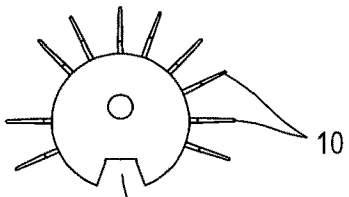
Figure 44C:
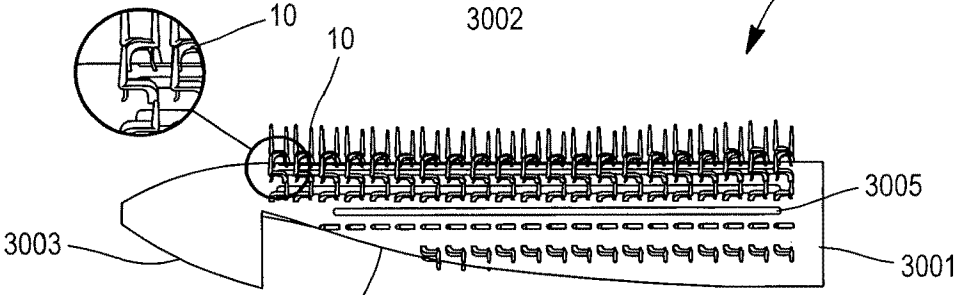

Referring to FIG. 44, there now follows a description of a second embodiment of a developable hollow core 3000. In this variant embodiment, the core 3000 comprises a tube 3001 comprising a longitudinal slit 3002. An outer surface of the tube 3001 comprises a layout of spikes 10 which can have the structure of one of the spikes described previously. At one end, the core 3000 comprises a nose cone 3003 of essentially tapered form. At the end where the nose cone 3003 is placed, the tube 3001 comprise a slanted cut 3004. This cut will allow the tube 3001 to be able to be developed without being hampered by the nose cone 3003. Also, the core 3000 comprises, as illustrated here, longitudinal orifices 3005 passing through a thickness of the tube 3001 and situated between the longitudinal rows of spikes 10. In a variant embodiment, the core 3000 does not include longitudinal orifices.

Figure 45A:
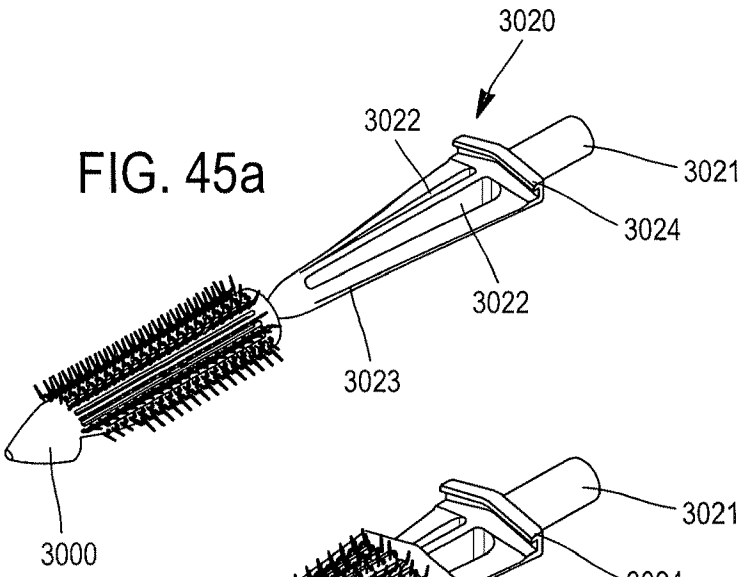
FIG. 45 presents three-dimensional views of a mounting of the core of FIG. 44 on a second embodiment of an associated support of an applicator device according to the invention.
Figure 45B:
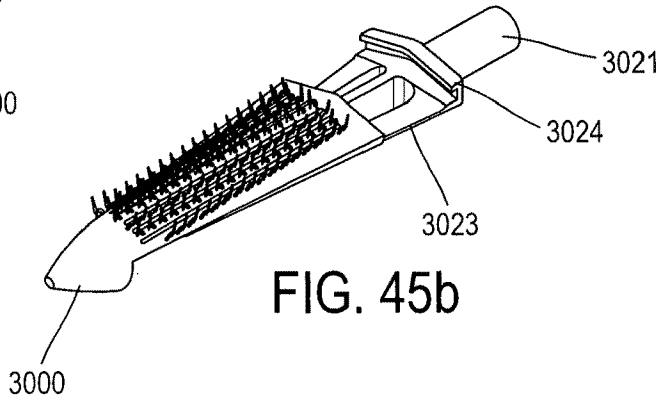
Figure 45C:
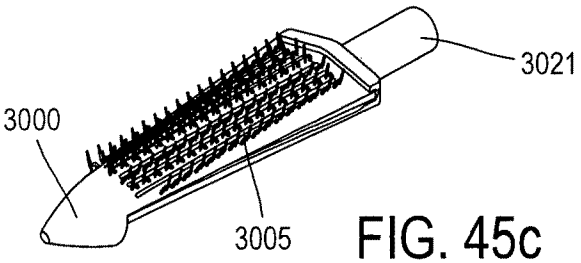

Referring to FIG. 45, the applicator device 3020 according to the invention comprises a support 3021 intended to receive the core 3000 by sliding. The support comprises a body 3023 in epee form comprising two longitudinal reservoirs 3022 that are open on the top and intended to receive the liquid or pasty product to be applied. The body 3023 is terminated by a guard 3024. As illustrated in FIG. 45, the developable hollow core 3000 is slidingly threaded onto the body 3023 of the support 3021, the form of the body 3023 being arranged so as to progressively develop the tube 3001 until the core 3000 comes into bearing contact against the guard 3024, the nose cone 3003 receiving a point of the body of the support 3021. Once in place, the longitudinal orifices 3005 allow the product stored in the reservoirs 3022 to arrive at the spikes 10.

Figure 46:
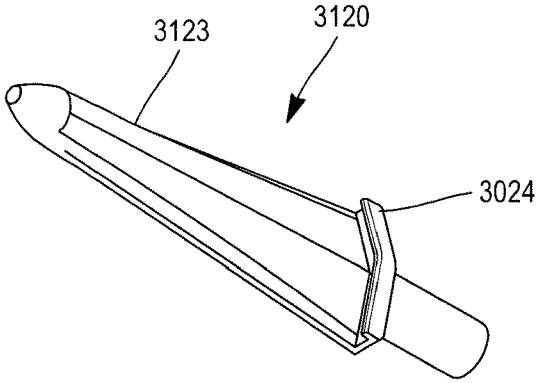

FIG. 46 illustrates a first variant of the support 3120 in which the body 3123 is solid and has no reservoirs.

Figure 47A:
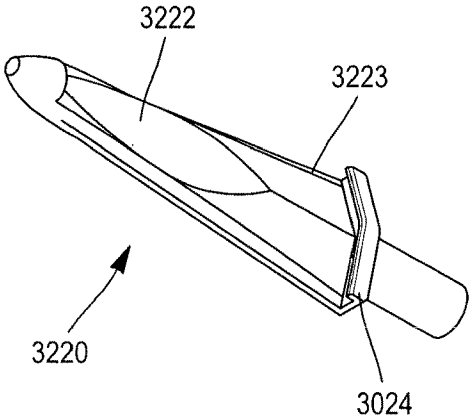
Figure 47B:
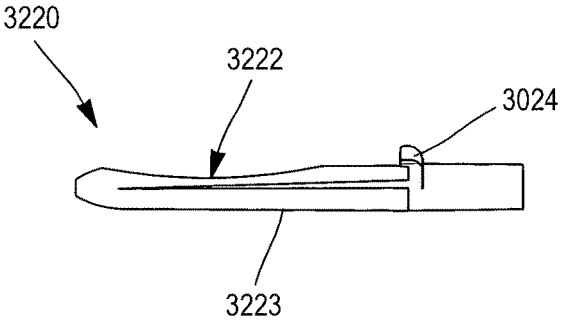

FIG. 47 illustrates a second variant of the support 3220 in which the body 3223 comprises a recess 3222 which serves as product reservoir, once the core 3000 is put in place on the support 3220.

Figure 48A:
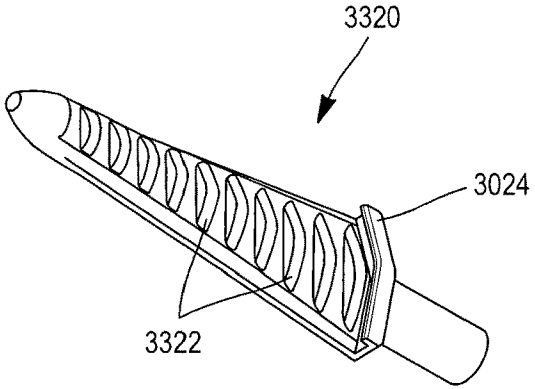
FIGS. 46 to 49 are views illustrating variant embodiments of the second embodiment of the support associated with the core of FIG. 44.
Figure 48B:
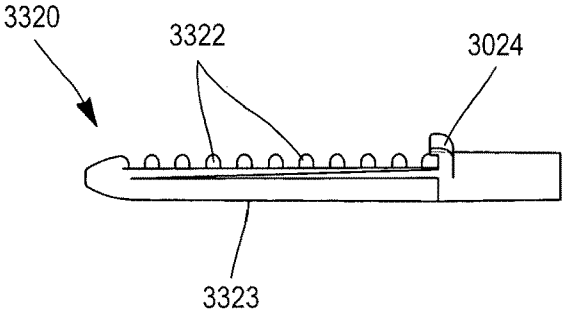

FIG. 48 illustrates a third variant of the support 3320 in which the body 3323 comprises a series of bosses 3322 extending protruding from a top face which is covered by the core 3000, once in place on the support 3320, the spacings between the bosses 3322 forming product reservoirs. It should be noted that, in addition, these spacings leave "voids" between the top face of the support 3320 and an internal face of the core 3000. These "voids" thus allow the core 3000 to bend upon the application of the cosmetic product, rendering the application gesture softer and more tactile (sensation of comfort), the spikes then pushing the core 3000 which "collapses" slightly opposite the spacings of the support 3320.

Figure 49:
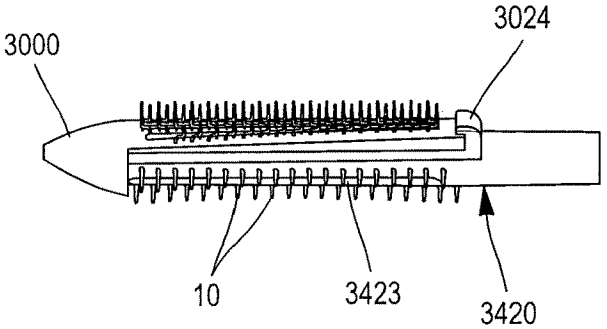

FIG. 49 illustrates a variant embodiment 3420 of one of the preceding supports in which the body 3423 comprises a layout of spikes 10 (which can have the structure of one of the spikes described previously) on a face opposite that covered by the core 3000 once the latter is in place.

Figure 50:
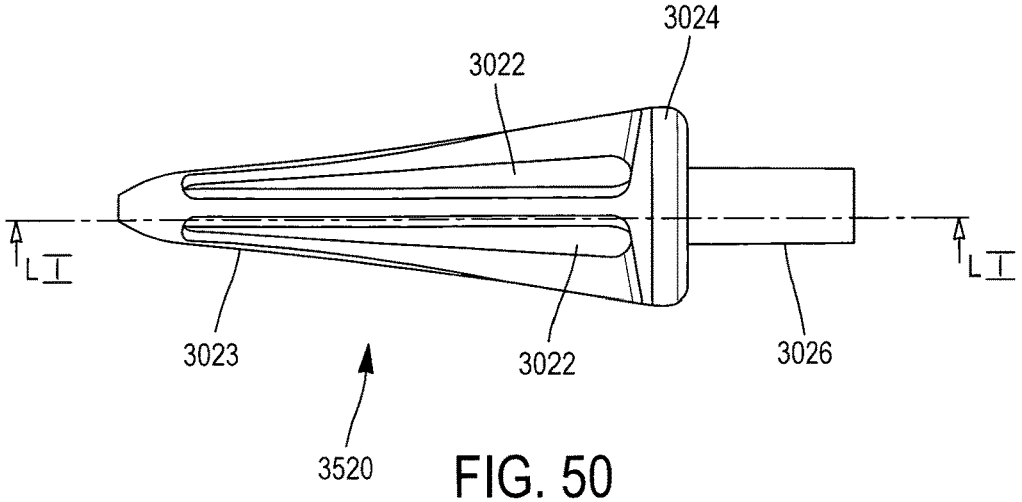
FIGS. 50 and 51 are a plan view and a view in cross section along LI-LI of a variant embodiment of the support associated with the core of FIG. 45.
Figure 51:
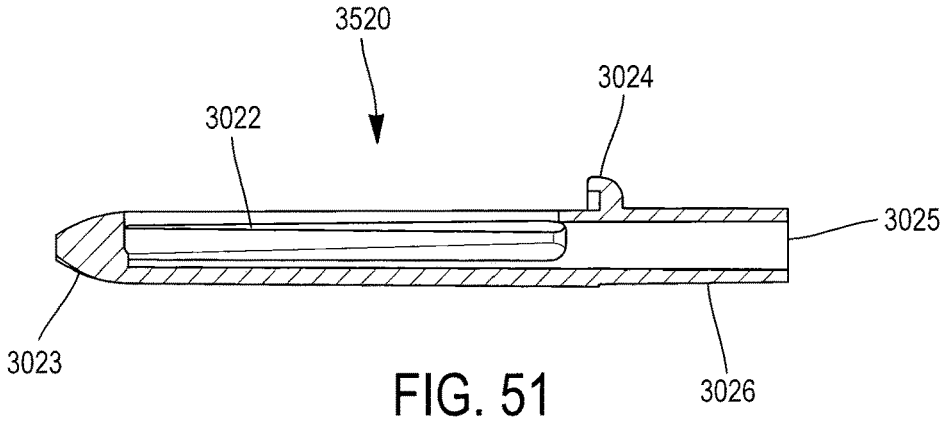
Figure 52:
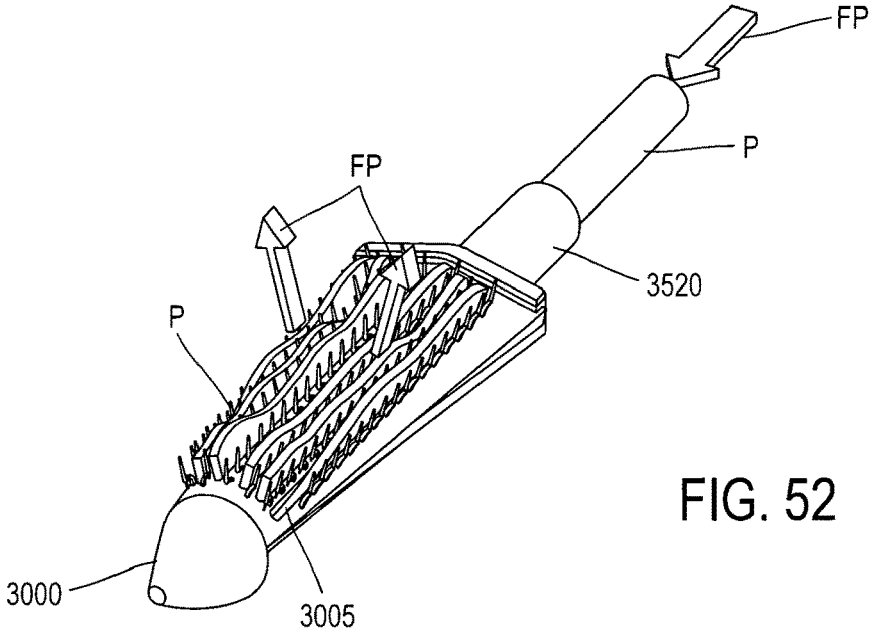
FIG. 52 is a three-dimensional view of the support associated with the core of FIG. 50 on which is mounted the hollow core of FIG. 44, with a flow for the cosmetic product.
Figure 53:
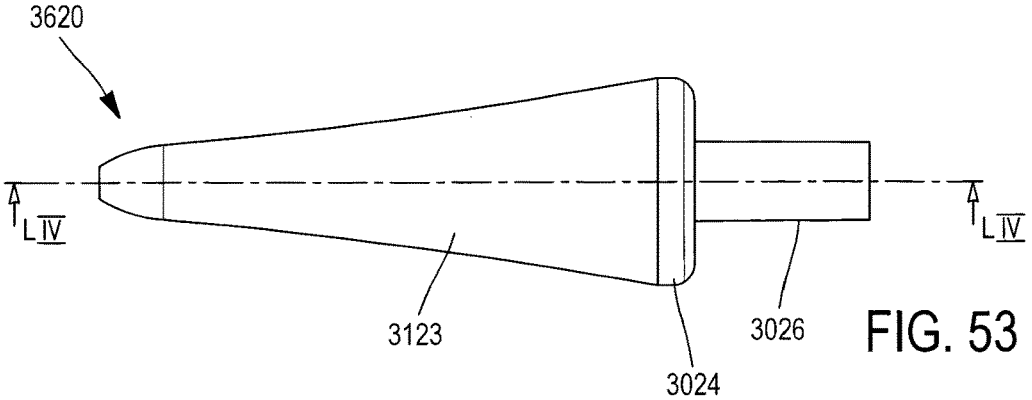
FIGS. 53 and 54 are a plan view and a view in cross section along LIV-LIV of a variant embodiment of the support associated with the core of FIG. 46.
Figure 54:
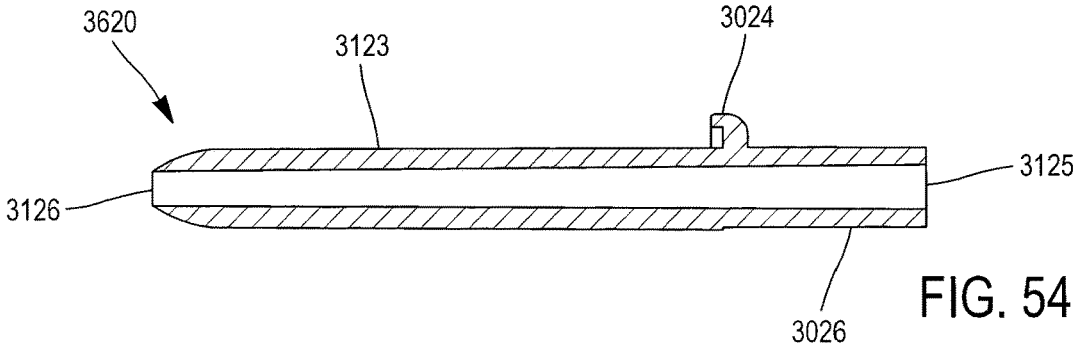
Figure 55:
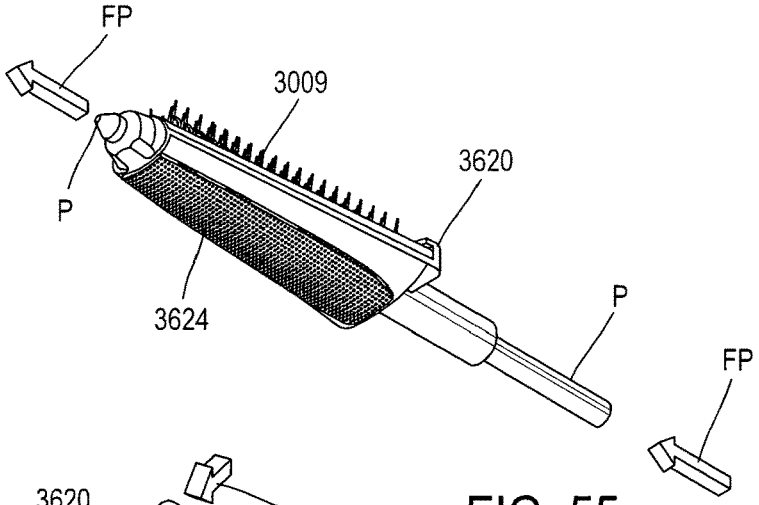
FIGS. 55 and 56 are three-dimensional views of the support associated with the core of FIG. 53 on which is mounted a hollow core, with a flow for the cosmetic product.
Figure 56:
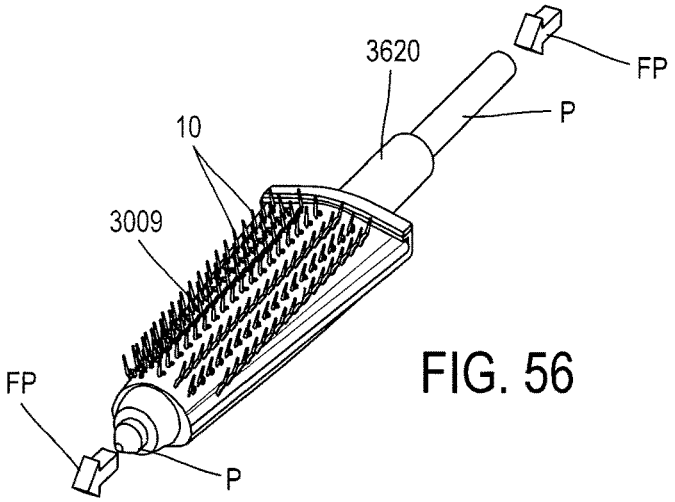

FIGS. 50 to 52 illustrate a variant embodiment 3520 of one of the preceding supports, in particular the support 3021. The support 3520 is similar to the support 3021 except that it also comprises a duct 3025 that passes coaxially through a handle 3026 of the guard 3024 so as to emerge in the top-open longitudinal reservoirs 3022 of the body 3023. In a use illustrated in FIG. 52, the cosmetic or care product P follows a flow illustrated by the arrows FP by entering through the rear of the handle 3026 into the duct 3025 then flowing into the reservoirs 3022 to finish by exiting through the longitudinal orifices 3005 of the core 3000 put in place on the support 3520.

Referring to FIGS. 53 to 56, there now follows a description of a variant embodiment 3620 of one of the preceding supports, in particular, without being limiting, the support 3120. The support 3620 is similar to the support 3120 except that it comprises a duct 3125 that passes longitudinally through the support 3620 from an end of the handle 3026 of the guard 3024 to an end 3126 of the body 3123. In a use illustrated in FIG. 55 or in FIG. 56, the cosmetic or care product P follows a flow illustrated by the arrows FP by entering through the rear of the handle 3026 into the duct 3125 then flowing along the duct 3125 to emerge through the end 3126, in the manner of a lead of a mechanical pencil.

The support 3620 is mounted, here, with a hollow core 3009 which is a variant embodiment of the hollow core 3000 previously described, adapted for the support 3620 so as to leave the output end 3126 of the duct 3125 free. Also, the support 3620 comprises a face 3624, generally opposite a face of the support 3620 on which the hollow core 3009 is mounted, which has a particular structure: a flock coating, or an additional layer of a softer material, of sponge type for example, having cells, or a microstructuring of said face 3624, or even any layer of soft and microstructured material having the same effect as an area at an end of the fingers that a user would naturally use.

Figure 57:
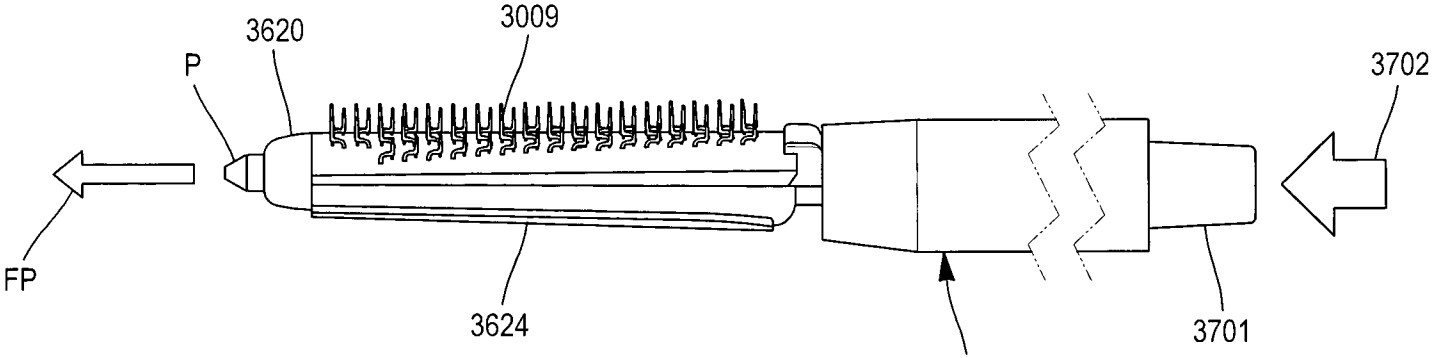
FIGS. 57 and 58 are side views of two variant embodiments of an applicator device according to the invention comprising the support associated with the core of FIGS. 53 to 56.
Figure 58:
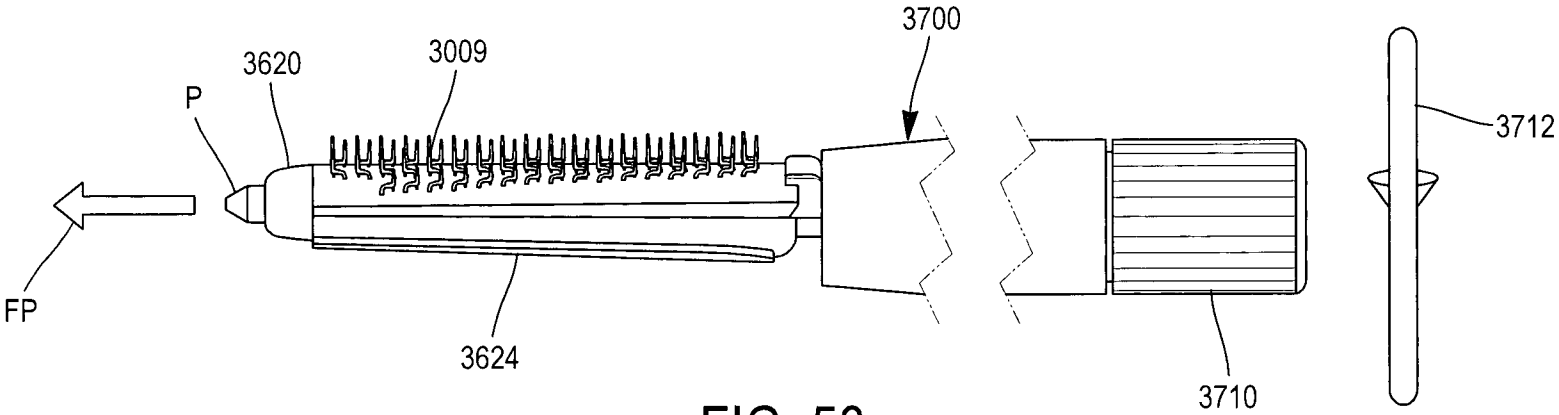

In variant embodiments of an applicator device according to the invention, illustrated in FIGS. 57 and 58, the latter comprises a shaft 3700 mounted on the handle 3026 of the support 3620 and comprises means 3701, 3710 for implementing the flow, illustrated by the arrow FP, for the product P. The implementing means 3701 is a pushbutton 3701 on which a thrust action 3702 provokes a flow of the product P. Also, the implementing means 3710 is a ring 3710 mounted to rotate and arranged so that a rotation 3712 of the ring 3710 provokes a flow of the product P. The pushbutton 3701 or the ring 3710 acts, for that, on a product P dosing system arranged within the shaft 3700. This dosing system is a pump or a device of mechanical pencil type depending on the consistency of the product P used.

It emerges from the above that such a structure of the spike, as described previously, for an applicator device according to the invention makes it possible to retain a distal stage that is sufficiently rigid to allow the keratinous fibers to be disentangled while guiding them, the flexible link formed by the proximal stage and/or the bridge serving as damper making it possible to erase the poking sensation when the free end of the spike comes into contact with the underlying skin. Also, the deformation thus obtained in use at the base of the spike allows the product present at that point to rise to the free end of the spike.

Ultimately, the applicator device according to the invention makes it possible to improve the charge of cosmetic or care product and its application on keratinous fibers (while ensuring an optimal separation thereof) or the epidermis while providing a sensation of optimal comfort for its user.

Obviously, many modifications can be made to the invention without in any way departing from the scope thereof.

The invention claimed is:

1. An applicator device for applying a fluid or pasty product onto keratinous fibers or onto the skin, the device comprising:

an elongate core extending along a longitudinal axis (X) and of longitudinal cylindrical form, and a plurality of spikes, distributed on the core, each spike extending from an anchoring end in the core to a free end and being made of a piece with the core, wherein each spike comprises, from the anchoring end to the free end, a proximal stage, a bridge and a distal stage, with at least one of the proximal stage and the bridge forming a flexible link whereas the distal stage is rigid relative to the flexible link, wherein the proximal stage and the bridge stage of each spike define a plane of symmetry and extend along the plane of symmetry, wherein the plane of symmetry intersects the longitudinal axis (X) in such a way that the longitudinal axis is included into the plane of symmetry and wherein the distal stage includes a main extension oriented away from the longitudinal axis forming an acute angle with the plane of symmetry, and wherein the proximal stage extends along a curve direction, the bridge being situated closer to the longitudinal axis than an apex of the curve direction of the proximal stage.

2. The applicator device according to claim 1, wherein the proximal stage forms the flexible link between the anchoring end and the bridge.

3. The applicator device according to claim 1, wherein the bridge forms the flexible link between the proximal and distal stages.

4. The applicator device according to claim 1, wherein the spikes are distributed on the core in adjacent rows, such that the spikes of one row are oriented in a same way and the spikes of an adjacent row are oriented differently.

5. The applicator device as claimed in claim 4, wherein the spikes of the adjacent row are oriented at 90° or at 180°.

* * * * *